US009545797B2

(12) United States Patent
Onodera et al.

(10) Patent No.: US 9,545,797 B2
(45) **Date of Patent: *Jan. 17, 2017**

(54) RECORDING MEDIUM HEATING APPARATUS AND SYSTEM INCLUDING THE RECORDING MEDIUM HEATING APPARATUS

(71) Applicants: RICOH COMPANY, LTD., Tokyo (JP); SCREEN HOLDINGS CO., LTD., Kyoto-shi (JP)

(72) Inventors: Ken Onodera, Ibaraki (JP); Genichiroh Kawamichi, Ibaraki (JP); Yasuhide Nakazawa, Ibaraki (JP); Yutaka Nagasawa, Ibaraki (JP); Shinji Nagayama, Ibaraki (JP)

(73) Assignees: Ricoh Company, Ltd., Tokyo (JP); SCREEN Holdings Co., Ltd., Kyoto-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/631,420

(22) Filed: Feb. 25, 2015

(65) Prior Publication Data

US 2015/0174921 A1 Jun. 25, 2015

Related U.S. Application Data

(62) Division of application No. 14/151,311, filed on Jan. 9, 2014, now Pat. No. 9,409,416.

(30) Foreign Application Priority Data

Feb. 19, 2013 (JP) ..... 2013-030361
Oct. 29, 2013 (JP) ..... 2013-224628

(51) Int. Cl.
*B41J 2/01* (2006.01)
*B41J 11/00* (2006.01)
(Continued)

(52) U.S. Cl.
CPC ..... *B41J 11/002* (2013.01); *B41F 3/52* (2013.01); *B41F 23/042* (2013.01); *F26B 3/20* (2013.01)

(58) Field of Classification Search
CPC combination set(s) only.
See application file for complete search history.

(56) References Cited

U.S. PATENT DOCUMENTS 6,079,330 A 6/2000 Aoki et al.
7,123,281 B2 * 10/2006 Okada ..... B41J 2/32 347/228

(Continued)

FOREIGN PATENT DOCUMENTS

JP 10-202839 8/1998
JP 2008-214805 9/2008
WO WO 2008/108010 A1 9/2008

OTHER PUBLICATIONS

U.S. Office Action mailed Aug. 4, 2015, in co-pending U.S. Appl. No. 14/151,311.

(Continued)

*Primary Examiner* — Matthew Luu
*Assistant Examiner* — Tracey McMillion
(74) *Attorney, Agent, or Firm* — Oblon, McClelland, Maier & Neustadt, L.L.P.

(57) ABSTRACT

A recording medium heating apparatus includes a plurality of heat rollers disposed in a feeding path of a recording medium and having respective heating units; and a control unit controlling temperatures of the heating units so that the temperature of a first heat roller is lower than the temperature of a second heat roller. Further, the first and the second heat rollers are included in the plurality of heat rollers and the first heat roller is disposed on the upstream side of the second heat roller in the feeding path.

13 Claims, 15 Drawing Sheets

(51) Int. Cl.

| | |
|---|---|
| ***B41F 23/04*** | (2006.01) |
| ***F26B 3/20*** | (2006.01) |
| ***B41F 3/52*** | (2006.01) |

(56) References Cited

U.S. PATENT DOCUMENTS

| | | | | |
|---|---|---|---|---|
| 2002/0105630 | A1* | 8/2002 | Hashiguchi | G03D 13/002 355/405 |
| 2005/0280689 | A1 | 12/2005 | Preszler et al. | |
| 2009/0244235 | A1 | 10/2009 | Houjou | |
| 2011/0267393 | A1 | 11/2011 | Okamoto | |
| 2012/0200651 | A1 | 8/2012 | Sasada | |
| 2013/0293617 | A1* | 11/2013 | Suzuki et al. | 347/16 |

OTHER PUBLICATIONS

Office Action mailed Nov. 9, 2015, in co-pending U.S. Appl. No. 14/151,311.

* cited by examiner

RECORDING MEDIUM HEATING APPARATUS AND SYSTEM INCLUDING THE RECORDING MEDIUM HEATING APPARATUS

CROSS-REFERENCE TO RELATED APPLICATIONS

The present application is a divisional application of U.S. application Ser. No. 14/151,311, filed Jan. 9, 2014, which is based on and claims the benefit of priority under 35 U.S.C. §119 of Japanese Patent Application Nos. 2013-030361 filed on Feb. 19, 2013, and 2013-224628, filed on Oct. 29, 2013. The entire contents of the above-identified applications are incorporated herein by reference.

BACKGROUND OF THE INVENTION

1. Field of the Invention

The present invention generally relates to a recording medium heating apparatus and a system including the recording medium heating apparatus.

2. Description of the Related Art

To evaporate ink solvent printed on a sheet in a printing apparatus such as a rotary press, there is a known technique in which a plurality of heat rollers provided along the sheet feeding path are used to dry the sheet (see, for example, Japanese Laid-open Patent Publication No. H10-202839 (hereinafter "Patent Document 1")).

SUMMARY OF THE INVENTION

According to an aspect of the present invention, a recording medium heating apparatus includes a plurality of heat rollers disposed in a feeding path of a recording medium and having respective heating units; and a control unit controlling temperatures of the heating units so that the temperature of a first heat roller is lower than the temperature of a second heat roller. Further, the first and the second heat rollers are included in the plurality of heat rollers and the first heat roller is disposed on the upstream side of the second heat roller in the feeding path.

BRIEF DESCRIPTION OF THE DRAWINGS

Other objects, features, and advantages of the present invention will become more apparent from the following description when read in conjunction with the accompanying drawings, in which.

DETAILED DESCRIPTION OF THE PREFERRED EMBODIMENTS

In related technologies of drying sheet using plural heat rollers in a printing apparatus such as a rotary press, the sheet may be damaged due to the heat applied to the sheet while in the printing apparatus.

The present invention is made in light of the problem, and may provide a recording medium heating apparatus that heats a recording medium while reducing damage to the recording medium.

In the following, embodiments of the present invention are described in detail.

First Embodiment

Figure 1:
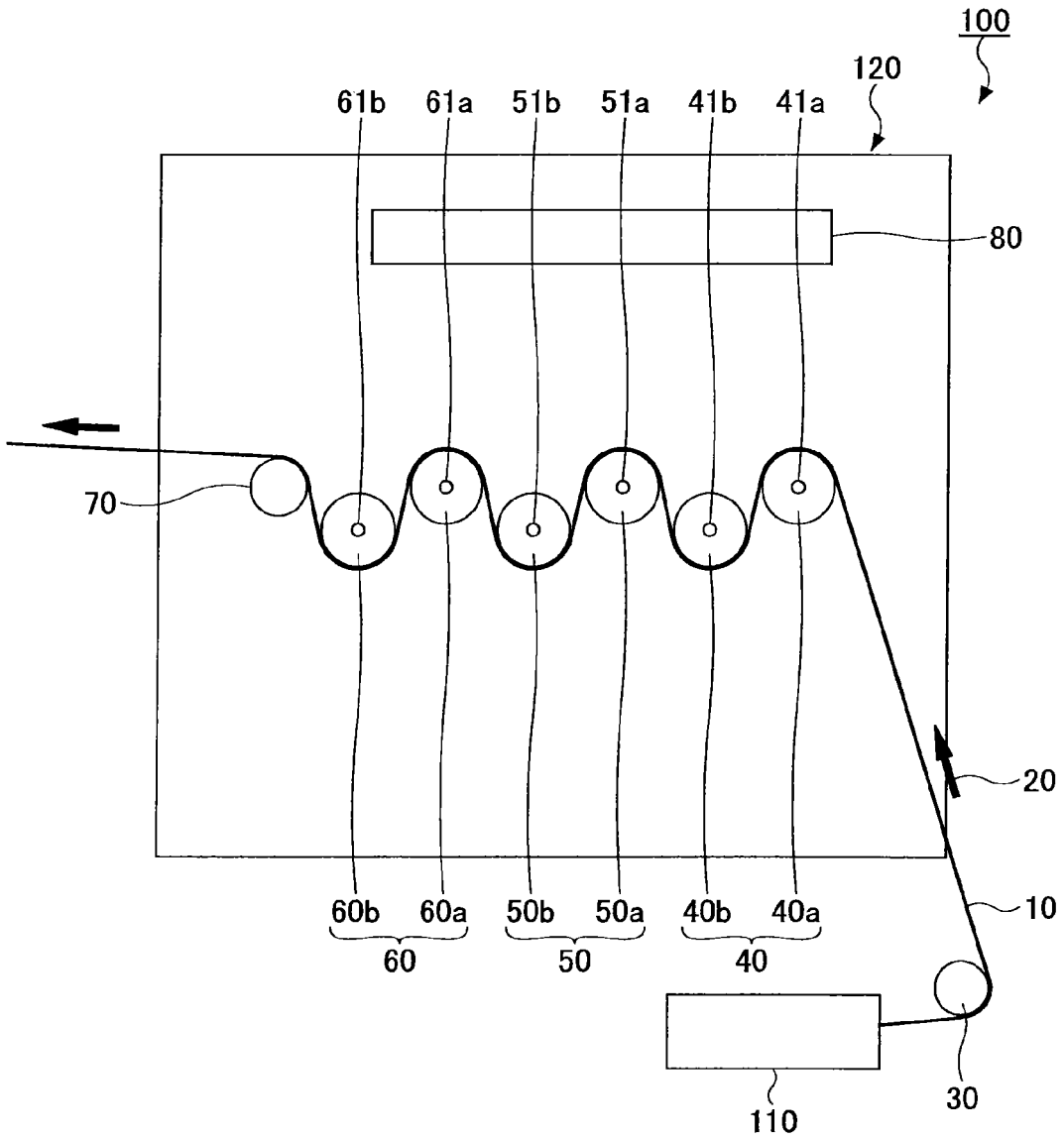
FIG. 1 schematically illustrates an example of a system including a recording medium heating apparatus according to a first embodiment of the present invention.

FIG. 1 schematically illustrates a system 100 including a recording medium heating apparatus 120 according to a first embodiment. As illustrated in FIG. 1, the system 100 includes a recording apparatus 110 and the recording medium heating apparatus 120.

The recording apparatus 110 is a printing apparatus that forms image information by adhering ink onto a recording medium 10 and may be a rotary press (printing machine), an inkjet printer, or a facsimile machine.

The recording medium 10 is fed in the feed direction 20 as indicated by an arrow of FIG. 1 from the recording apparatus 110 to the recording medium heating apparatus 120 using a supply feed roller 30. In the case of FIG. 1, the recording medium 10 is depicted as a continuous form.

However, the recording medium 10 may be a single sheet having a relatively longer length in the sheet feed direction. The material of the recording medium 10 is not limited to paper. Namely, the recording medium 10 may be made of a material such as a plastic sheet that is likely to be damaged by, for example, forming wrinkles or being deformed due to heat.

The recording medium heating apparatus 120 includes a first heat roller set 40, a second heat roller set 50, and a third heat roller set 60, a discharge feed roller 70, and a control apparatus 80. The first heat roller set 40 includes a first rear-surface heat roller 40*a* and a first front-surface heat roller 40*b*.

The second heat roller set 50 includes a second rear-surface heat roller 50*a* and a second front-surface heat roller 50*b*. The third heat roller set 60 includes a third rear-surface heat roller 60*a* and a third front-surface heat roller 60*b*.

The first heat roller set 40, the second heat roller set 50, and the third heat roller set 60 are sequentially disposed in this order in the feed direction 20 along a feeding path of the recording medium 10 from an upstream side to a downstream side.

The heat rollers 40*a*, 40*b*, 50*a*, 50*b*, 60*a*, and 60*b* (hereinafter simplified as heat rollers "40*a*-60*b*") are rotatably supported by respective bearings at both ends in the longitudinal direction thereof.

As illustrated in FIG. 1, the first rear-surface heat roller 40*a*, the first front-surface heat roller 40*b*, the second rear-surface heat roller 50*a*, the second front-surface heat roller 50*b*, the third rear-surface heat roller 60*a*, and the third front-surface heat roller 60*b* are separated from each other and disposed in a zigzag manner.

In this case, for example, a line connecting the rotational centers of the first rear-surface heat roller 40*a*, the second rear-surface heat roller 50*a*, and the third rear-surface heat roller 60*a* is separated from and parallel to a line connecting the rotational centers of the first front-surface heat roller 40*b*, the second front-surface heat roller 50*b*, and the third front-surface heat roller 60*b*.

The heat rollers 40*a*-60*b* include respective heaters 41*a*, 41*b*, 51*a*, 51*b*, 61*a*, and 61*b* (hereinafter simplified as heaters "41*a*-61*b*"). By using the heaters 41*a*-61*b*, it becomes possible to heat the surfaces of the heat rollers 40*a*-60*b*.

The heat rollers 40*a*-60*b* further include respective temperature sensors (not shown) such as thermistors, thermopiles or the like to detect the surface temperatures of the heat rollers 40*a*-60*b*.

The heat rollers 40*a*-60*b* may further include respective heat pipes (not shown) therein. By having the heat pipes, it may become possible to effectively transfer heat in the longitudinal direction of the heat rollers 40*a*-60*b* and uniformly maintain the temperatures of the surfaces of the heat rollers 40*a*-60*b* ("roller surfaces"). Accordingly, it becomes possible to effectively supply heat to the recording medium 10.

The surfaces of the heat rollers 40*a*-60*b* are coated with a non-adhesive film such as fluorine resin, so that adhesion of ink and the like to the roller surfaces can be reduced and reduction of the efficiency of heat transfer to the recording medium 10 due to adherence to the roller surfaces can be prevented.

The recording medium 10 is sequentially wound around the first rear-surface heat roller 40*a*, the first front-surface heat roller 40*b*, the second rear-surface heat roller 50*a*, the second front-surface heat roller 50*b*, the third rear-surface heat roller 60*a*, and the third front-surface heat roller 60*b* that are arranged in the zigzag manner in the feed direction from upstream to downstream. As a result, the recording medium 10 passes through the heat rollers 40*a*-60*b* in the zigzag manner.

Accordingly, during feeding, the rear surface ("one surface") of the recording medium 10 facing downward is in contact with the first rear-surface heat roller 40*a*, the second rear-surface heat roller 50*a*, and the third rear-surface heat roller 60*a*.

Further, during feeding, the front surface ("the other surface") of the recording medium 10 facing upward is in contact with the first front-surface heat roller 40*b*, the second front-surface heat roller 50*b*, and the third front-surface heat roller 60*b*.

Figure 2:
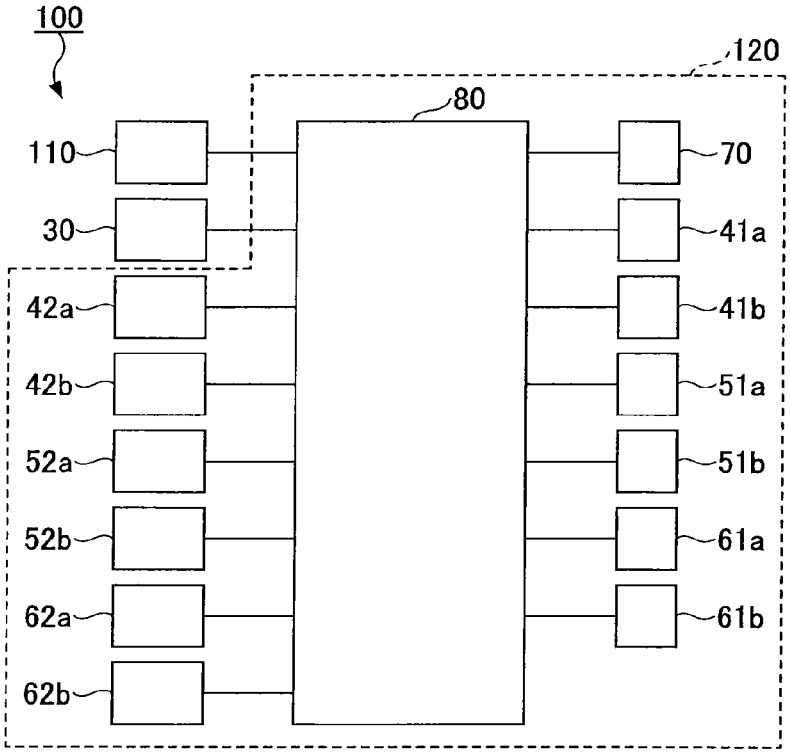
FIG. 2 is an example of a schematic block diagram of the system in FIG. 1.

FIG. 2 is an example block diagram of the system 100 in FIG. 1. As illustrated in FIG. 2, the control apparatus 80 is connected to temperature sensors 42*a*, 42*b*, 52*a*, 52*b*, 62*a*, and 62*b* (hereinafter temperature sensors "42*a*-62*b*"), the heaters 41*a*-61*b*, the discharge feed roller 70, the supply feed roller 30, and the recording apparatus 110.

The control apparatus 80 controls the temperatures of the heat rollers 40*a*-60*b* based on actuated conditions including, for example, the temperatures of the heat rollers 40*a*-60*b* detected by the temperature sensors 42*a*-62*b* and the rotational speed of the discharge feed roller 70 and/or the supply feed roller 30.

The control apparatus 80 controls the heaters 41*a*-61*b* so that the temperature of a heat roller set disposed on the downstream side is higher or equal to the temperature of another heat roller set disposed on the upstream side among the first heat roller set 40, the second heat roller set 50, or the third heat roller set 60.

More specifically, the control apparatus 80 controls the heaters 41*a* and 41*b* so that the temperature of the first rear-surface heat roller 40*a* and the first front-surface heat roller 40*b* of the first heat roller set 40 are set to a first setting temperature T1, controls the heaters 51*a* and 51*b* so that the temperature of the second rear-surface heat roller 50*a* and the second front-surface heat roller 50*b* of the second heat roller set 50 are set to a second setting temperature T2, and controls the heaters 61*a* and 61*b* so that the temperature of the third rear-surface heat roller 60*a* and the third front-surface heat roller 60*b* of the third heat roller set 60 are set to a third setting temperature T3.

Further, the control apparatus 80 controls the heaters 41*a*-61*b* so that the third setting temperature T3 is higher than or equal to the second setting temperature T2, the second setting temperature T2 is higher than or equal to the first setting temperature T1, and the third setting temperature T3 is higher than the first setting temperature T1 (i.e., T3≥T2≥T1 and T3>T1).

To that end, the control apparatus 80 may control the heaters 41*a*-61*b* disposed in the respective heat rollers 40*a*-60*b* while calculating (forecasting) the respective temperatures after a certain time period by monitoring the progress of the temperature changes of the heat rollers 40*a*-60*b* and comparing the setting temperatures T1, T2, and T3 with the current temperatures.

Otherwise, for example, the control apparatus 80 may perform two-step (on/off) control by turning on the heaters until the temperatures reach the corresponding setting temperatures and turning off the heaters when the temperatures reach the corresponding setting temperatures continuously as needed.

Figure 3:
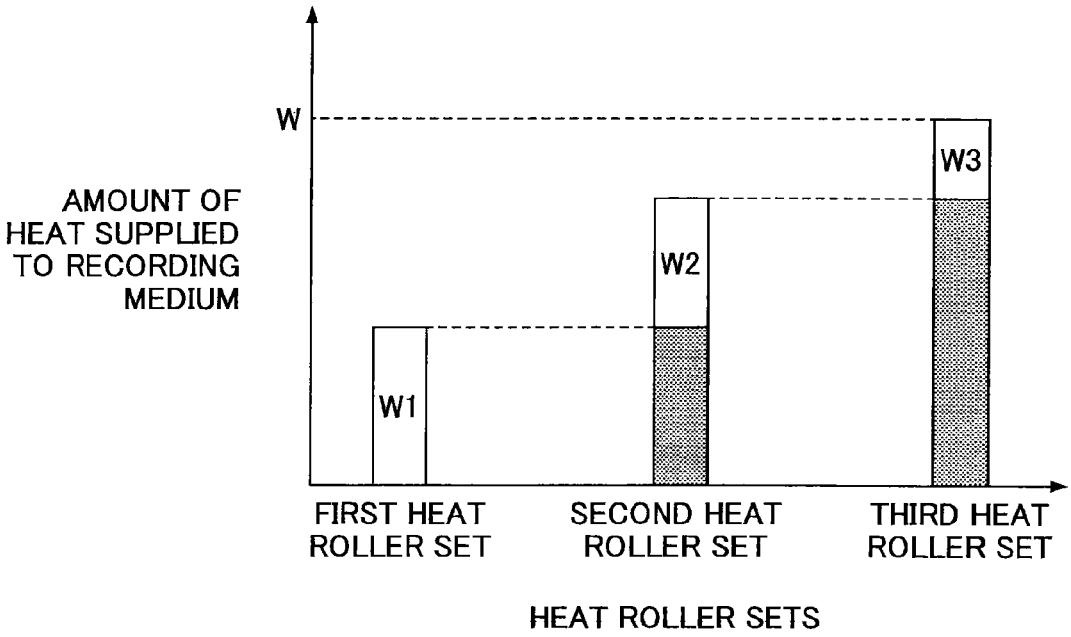
FIG. 3 is an example of a graph illustrating a relationship between amounts of heat received by a recording medium and heat roller sets.

As illustrated in FIG. 3, the control apparatus 80 performs control so that an amount of heat supplied from the first heat roller set 40 to the recording medium 10 is W1, an amount of heat supplied from the second heat roller set 50 to the recording medium 10 is W2, and an amount of heat supplied from the third heat roller set 60 to the recording medium 10 is W3.

Further, the control apparatus 80 controls the heaters 41*a*-61*b* so that a total amount of heat W (=amount of heat W1+amount of heat W2+amount of heat W3) is greater than an amount of heat that is sufficient to desirably evaporate moisture and solvent included in ink recorded on (supplied onto) the recording medium 10. In this case, the (separate) amounts of heat supplied from the heat rollers 40*a*-60*b* to the recording medium 10 may vary depending on the time period when the recording medium is in contact with the heat rollers 40*a*-60*b* (i.e., feeding speed of the recording medium 10). Therefore, the control apparatus 80 changes the setting temperatures T1, T2, and T3 based on the rotational speed of the discharge feed roller 70 and/or the supply feed roller 30.

The recording medium 10 on which ink is printed is fed to the recording medium heating apparatus 120 by the supply feed roller 30. The recording medium 10 fed to the recording medium heating apparatus 120 is in contact with and heated by the first rear-surface heat roller 40*a* of the first heat roller set 40 that is controlled by the control apparatus 80 so that the temperature of the first rear-surface heat roller 40*a* is the first setting temperature T1.

Then, the recording medium 10 is in contact with and heated by the first front-surface heat roller 40*b* of the first heat roller set 40 that is controlled by the control apparatus 80 so that the temperature of the first front-surface heat roller 40*b* is the first setting temperature T1.

The recording medium 10 on which ink is printed by the recording apparatus 110 is sequentially in contact with and heated by the second rear-surface heat roller 50*a* and the second front-surface heat roller 50*b* that are controlled by the control apparatus 80 so that the temperature thereof is the second setting temperature T2 and is further in contact with and heated by the third rear-surface heat roller 60*a* and the third front-surface heat roller 60*b* that are controlled by the control apparatus 80 so that the temperature thereof is the third setting temperature T3.

By doing this, the solvent component of the ink printed onto the recording medium 10 is evaporated in accordance with the heat applied by the first heat roller set 40 and the second heat roller set 50. Further, the solvent component of the ink is evaporated by the heat of the third heat roller set 60 so that the remaining solvent component of the ink printed onto the recording medium 10 is less than or equal to a corresponding predetermined value. After that, the recording medium 10 is discharged from the recording medium heating apparatus 120 by the discharge feed roller 70.

Therefore, the recording medium 10 is in contact with the first heat roller set 40 whose temperature is the first setting temperature T1 which is the lowest amongst the first heat roller set 40, the second heat roller set 50, and the third heat roller set 60. By doing this, it becomes possible to reduce the temperature difference between the recording medium 10 and the heat roller(s) with which the recording medium 10 is in the first contact.

Accordingly, when compared with a case where the temperature of all the heat rollers is set to the third setting temperature T3 which is the highest temperature, it becomes possible to prevent a sudden temperature increase of the recording medium 10. Namely, it becomes possible for the system 100 to minimize a thermal load applied to the recording medium 10. Also, it become possible for the system 100 to reduce the occurrence of damage (i.e., wrinkles, deformation and the like) to the recording medium 10 due to the thermal load.

Further, as described above, the third heat roller set 60 supplies heat to the recording medium 10 sufficient to evaporate the solvent component of ink so that the solvent component of ink is less than or equal to the corresponding predetermined value. Therefore, it becomes possible to improve the printing quality of image information formed on the recording medium 10.

Further, as the recording medium 10 is fed to the second heat roller set 50 and the third heat roller set 60, it becomes possible to gradually reduce the temperature difference between the recording medium 10 and the subsequent heat roller set. Further, it is possible to gradually reduce the amount of heat supplied from the heat roller sets 40, 50, and 60 when the recording medium is gradually fed from the upstream side to the downstream side.

By doing this, it becomes possible to prevent the occurrence of damage in which, for example, wire lines connected to the heaters 51*a* and 51*b* of the heat roller set 50 are cut due to heat load. Similarly, it becomes possible to prevent the occurrence of damage in which, for example, wire lines connected to the heaters 61*a* and 61*b* of the heat roller set 60 are cut due to heat load.

Further, in this first embodiment, a case is described where the control apparatus 80 controls the heaters 41*a*-61*b* so that the temperatures of the heat roller sets 40, 50, and 60 are set to the corresponding setting temperatures. However, for example, the control apparatus 80 may control the heaters 41*a*-61*b* so that the setting temperatures of the heaters 41*a*-61*b* are different from each other. In this case, the control apparatus 80 controls the heaters 41*a*-61*b* so that the setting temperature of the heater is gradually increased in the direction from the upstream side to the downstream side.

By doing this, it may become possible for the system 100 to effectively reduce the heat load applied to the recording medium 10. As a result, it becomes possible to effectively prevent the occurrence of damage (e.g., wrinkles and deformation) to the recording medium due to the heat load.

Further, the control apparatus 80 may control the heaters 41*a*-61*b* based on, for example, a type of recording medium 10 (i.e., a kind of a sheet), a type of ink, a position or an area of an image forming region (e.g., front-side printing, rear-side printing, double-sided printing, size of the printing region) and the like.

By doing this, it becomes possible for the system 100 to effectively prevent the occurrence of damage (e.g., wrinkles or deformation) to the recording medium 10 due to thermal load applied to the recording medium 10, thereby effectively enabling the acquisition of an improvement of the printing quality.

Second Embodiment

Figure 4:
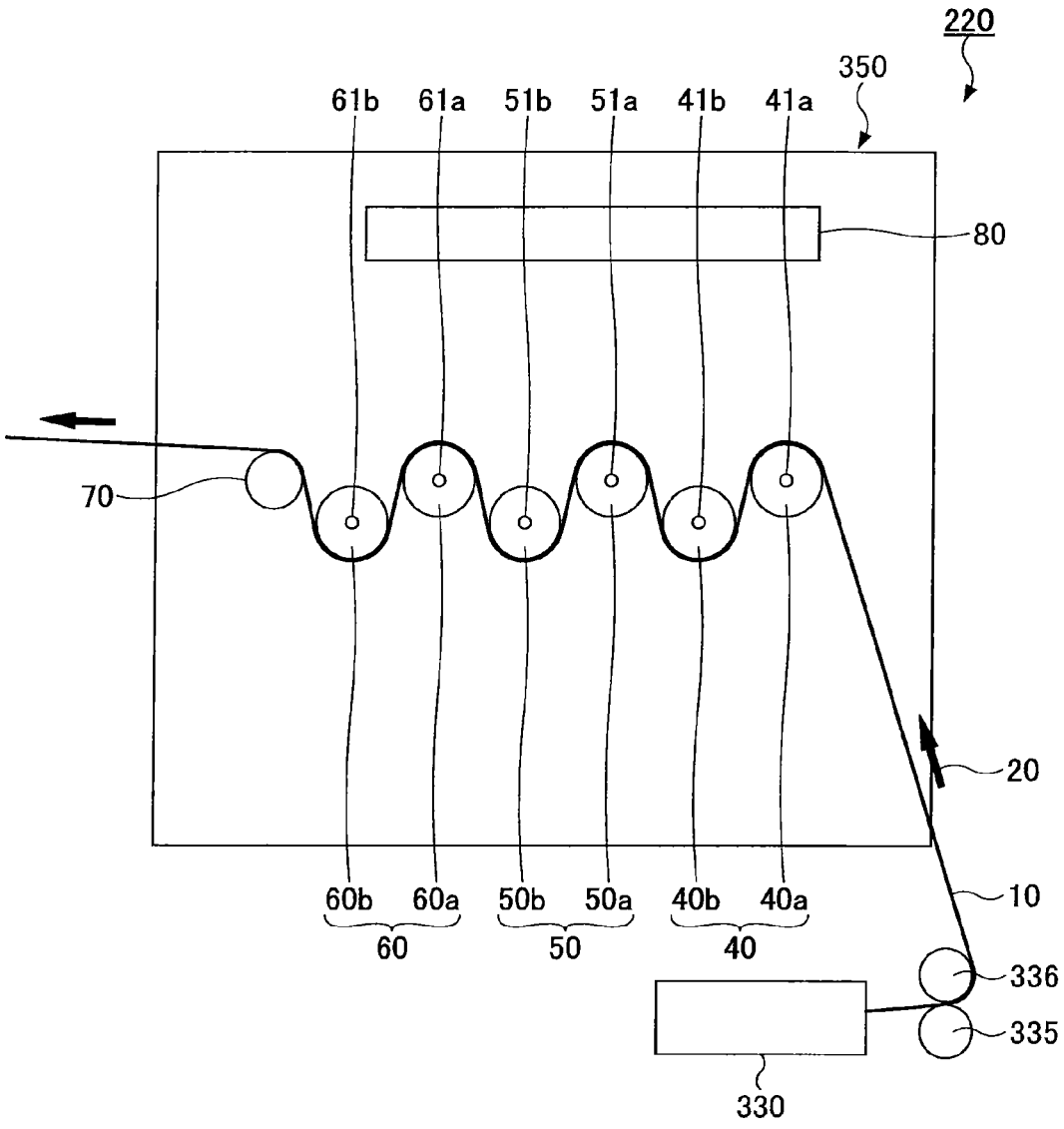
FIG. 4 schematically illustrates an example of a system including a preprocessing apparatus according to a second embodiment.
Figure 5:
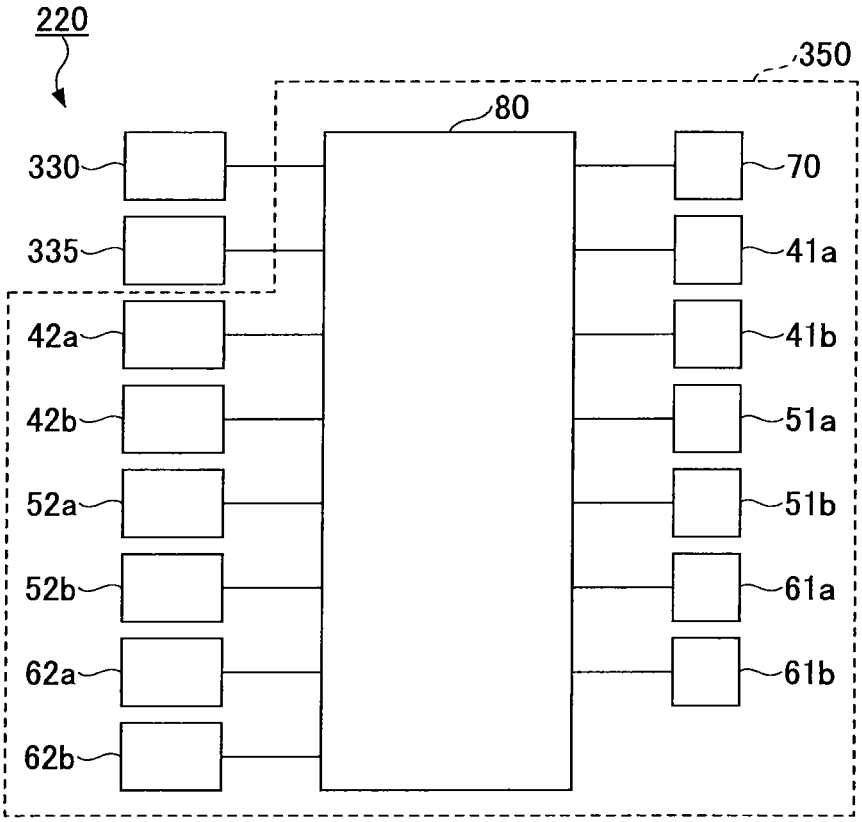
FIG. 5 is an example of a schematic block diagram of the system in FIG. 4.

Next, a second embodiment is described. FIG. 4 illustrates a preprocessing apparatus (preprocessing liquid application and drying apparatus) 220 having a recording medium heating apparatus 350 in a system 200. FIG. 5 illustrates a schematic block diagram of the preprocessing apparatus 220 having the recording medium heating apparatus 350.

In the following, the same reference numerals are repeatedly used to describe the same elements as those described in the first embodiment, so that parts different from those in the first embodiment are mainly described.

Figure 6:
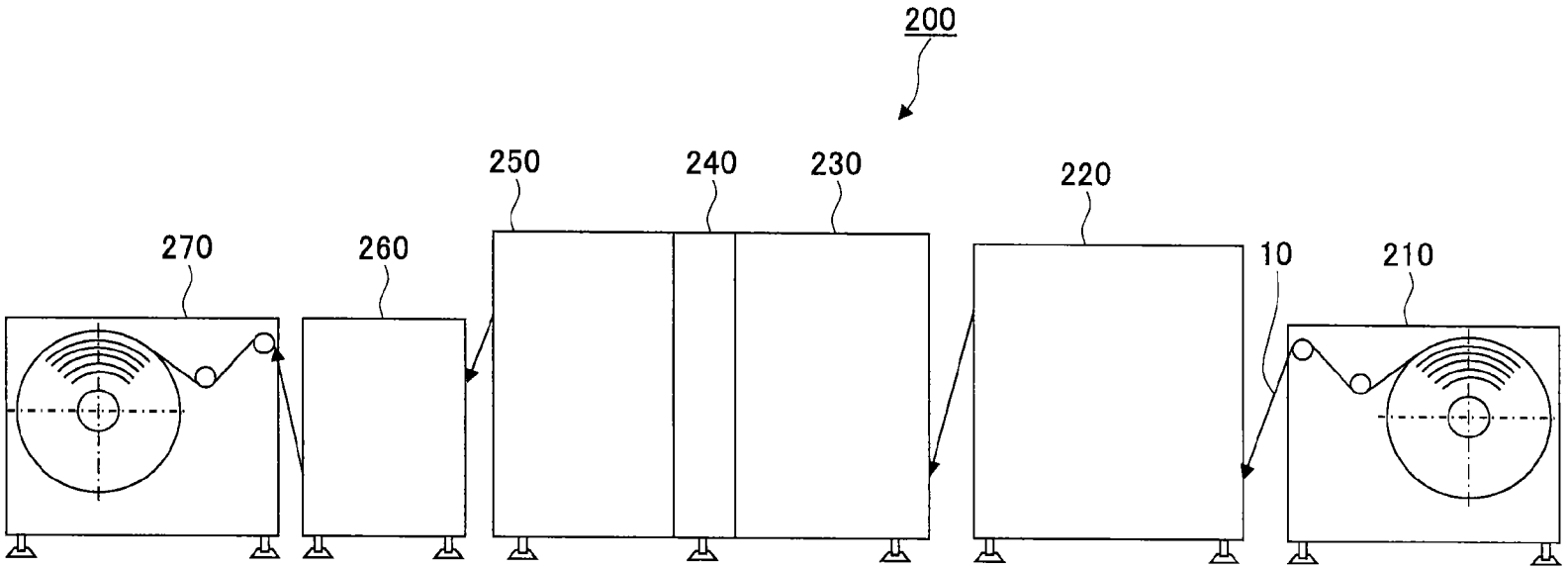
FIG. 6 schematically illustrates an example of a printing system including the heating apparatus of FIG. 4.

FIG. 6 illustrates a schematic configuration of a printing system 200 according to the second embodiment. As illustrated in FIG. 6, the printing system 200 includes a sheet supplying apparatus 210, the preprocessing apparatus 220, a first inkjet printer 230, a reversing apparatus 240, a second inkjet printer 250, a post drying apparatus 260, and a winding apparatus 270.

Figure 7:
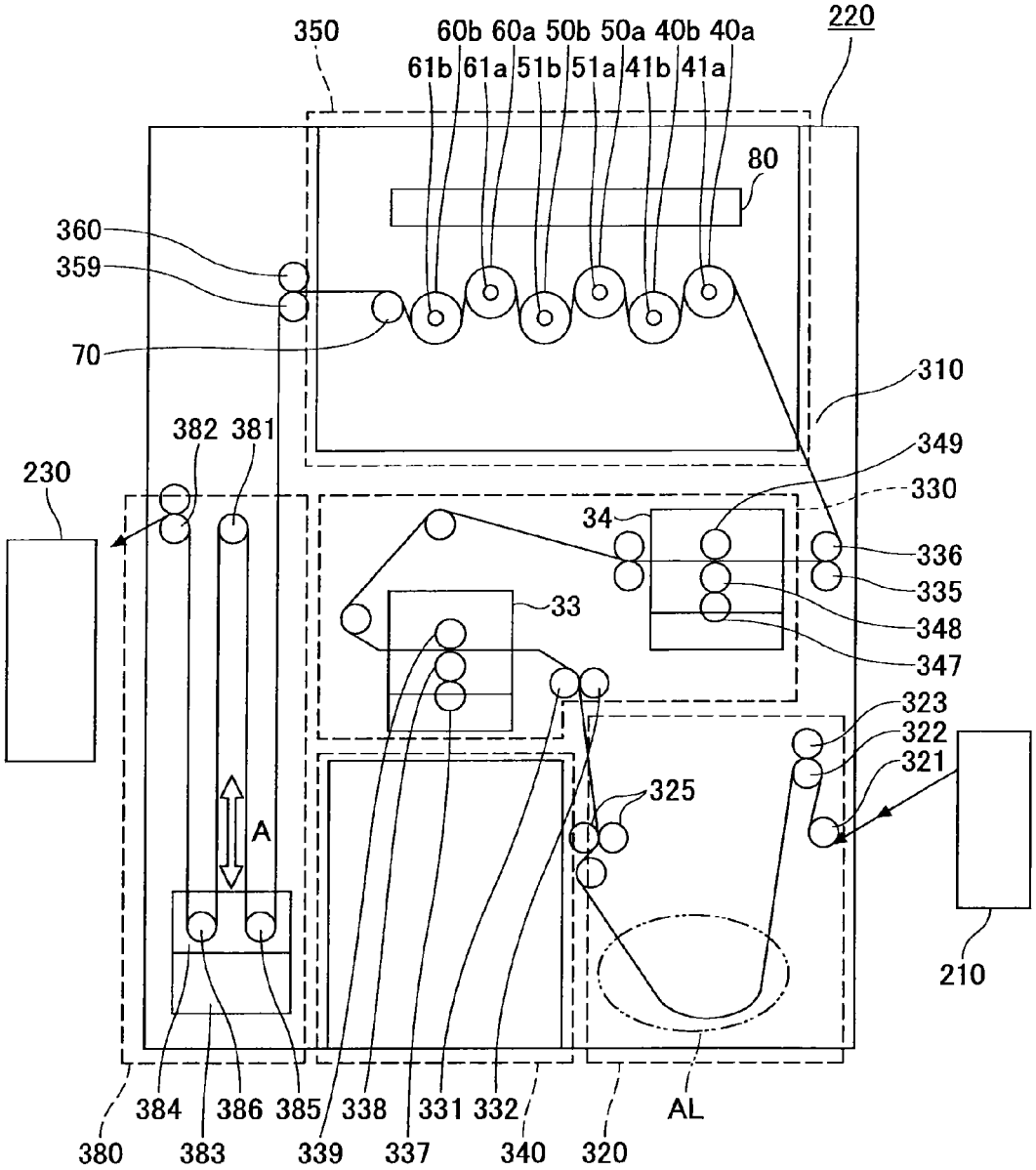
FIG. 7 schematically illustrates an example of a preprocessing liquid application and drying apparatus provided in the printing system.

FIG. 7 schematically illustrates a configuration of the preprocessing apparatus 220 including the recording medium heating apparatus (heating unit) 350 of the printing system 200 according to the second embodiment.

The sheet supplying apparatus 210 supplies the recording medium 10 to the preprocessing apparatus 220 disposed in the downstream side, the recording medium 10 being, for example, a continuous form having a long length in the feed direction and wound into a roll shape.

The preprocessing apparatus 220 is an example of a recording medium preprocessing apparatus and applies a preprocessing liquid to the surface(s) of the recording medium 10 to prevent the occurrence of blur or ink penetration onto the rear surface of the recording medium 10 in the first inkjet printer 230 and the like disposed in the downstream side.

Further, the preprocessing apparatus 220 heats and dries the applied preprocessing liquid on the recording medium 10 and then discharges the recording medium 10 to the first inkjet printer 230 disposed in the downstream side.

To that end, the preprocessing apparatus 220 includes the recording medium heating apparatus (heating unit) 350 (see FIGS. 4 and 7). Here, the configuration of the recording medium heating apparatus (heating unit) 350 in the preprocessing apparatus 220 is the same as that of the recording medium heating apparatus (heating unit) 120.

Therefore, the recording medium heating apparatus (heating unit) 350 also includes the heat rollers 40*a*-60*b*. In the recording medium heating apparatus (heating unit) 350, the control process (see FIG. 3) by the control apparatus 80 as described above is preformed, so as to control the amounts of heat to be supplied by the heaters 41*a*-61*b* of the heat rollers 40*a*-60*b*.

Based on image data to be printed, the first inkjet printer 230 discharges ink droplets onto the front surface ("the other surface") of the recording medium 10 onto which the preprocessing liquid is applied in the preprocessing apparatus 220, so as to form the desired image.

The reversing apparatus 240 reverses the surface of the recording medium 10, and feeds the reversed recording medium 10 to the second inkjet printer 250. Further, the reversing apparatus 240 includes a drier (not shown) as a drying unit to dry the image formed on the other surface of the recording medium 10 by the first inkjet printer 230.

Based on the image data to be printed, the second inkjet printer 250 discharges ink droplets onto the rear surface (the "one surface") of the recording medium 10 whose surfaces are reversed by the reversing apparatus 240, so as to form the desired image.

The post drying apparatus 260 includes a drier as a drying unit which exhausts hot air to dry the image formed on the front and the rear surfaces of the recording medium 10.

The winding apparatus 270 winds up and collects the recording medium 10 on which images are formed on one or both surfaces, wherein ink on the surfaces is dried by the post drying apparatus 260.

Next, with reference to FIG. 7, the preprocessing apparatus 220 is described. The preprocessing apparatus 220 corresponding to a preprocessing system in FIG. 7 includes a preprocessing liquid application apparatus (preprocessing liquid application unit) 330 that applies the preprocessing liquid to the recording medium 10.

The recording medium heating apparatus (heating unit) 350 that dries the preprocessing liquid on the recording medium 10 is disposed on the downstream side of the preprocessing liquid application apparatus 330.

In addition to the preprocessing liquid application apparatus 330 and the recording medium heating apparatus (heating unit) 350, the preprocessing apparatus 220 further includes an air loop unit 320 and a preprocessing liquid supplying unit 340, and a dancer unit 380.

The air loop unit 320 includes a guide roller 321, which is rotatably supported, and a feed-in (FI) roller 322 and an FI nip roller 323 which sandwiches and feeds the recording medium 10.

In the air loop unit 320, the guide roller 321, the feed-in (FI) roller 322 which is driven to rotate, and the FI nip roller 323 that rotates in accordance with the rotation of the feed-in (FI) roller 322 feed the recording medium 10 supplied from the sheet supplying apparatus 210 and pull the recording medium 10 into the air loop unit 320.

In this case, the rotation of the feed-in (FI) roller 322 is controlled by using an optical sensor (not shown) so that an air loop AL is formed where the amount of sagging of the recording medium 10 becomes constant.

Here, a tension force is applied to the recording medium 10 that has passed through the air loop AL by using a tension shaft (not shown) to stabilize the feeding of the recording medium 10, so that the recording medium 10 is fed to the preprocessing liquid application unit 330.

Figure 8:
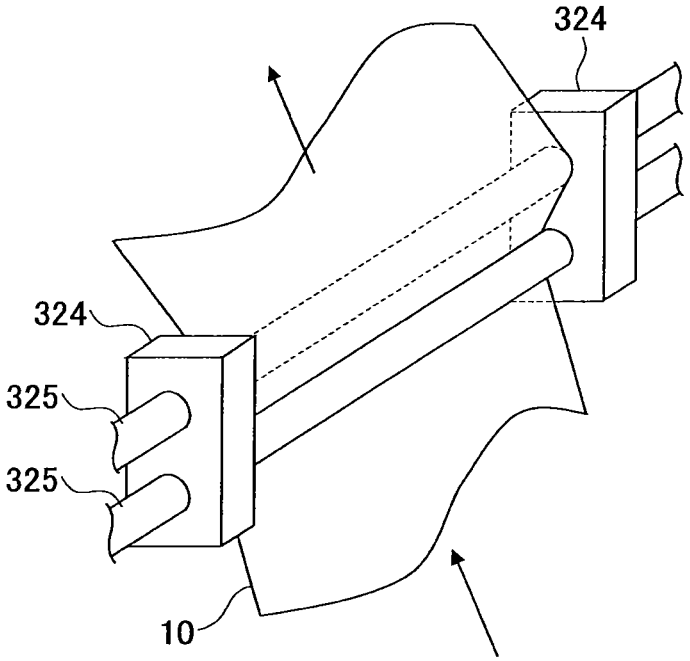
FIG. 8 is a schematic perspective view of an example of pass shafts and edge guides disposed in a feeding path of a recording medium in the preprocessing liquid application and drying apparatus of FIG. 7.

As illustrated in FIG. 8, the recording medium 10 having passed through the air loop AL further passes between two edge guides 324 and further enters an S-shaped path through two path shafts 325 which are disposed in a manner such that the longitudinal direction of the path shafts 325 is orthogonal to the feed direction (i.e., the arrow direction in FIG. 8) of the recording medium 10.

The two path shafts 325 are supported by two edge guides 324, and the distance between the two edge guides 324 is set to be substantially equal to the length in the width direction (width size) of the recording medium 10. Here the edge guides 324 are movably fixed relative to the path shafts 325 with, for example, screws, so that the distance between the two edge guides 324 can be adjusted in accordance with the width size of the recording medium 10 to be used.

By using the path shafts 325 and the edge guides 324, it becomes possible to determine the feeding position of the recording medium 10 in the width direction, so that stable feeding can be achieved.

To stabilize feeding of the recording medium 10, a tension force is applied to the recording medium 10, having passed between the path shafts 325 and the edge guides 324, by using the tension shaft (not shown) whose position is fixed in a fixed state.

The preprocessing liquid application unit 330 includes a infeed roller 331 that is driven to rotate, a feed nip roller 332, a rear-surface application unit 33, a front-surface application unit 34, an outfeed roller 335 that is driven to rotate, and a feed nip roller 336. The feed nip roller 332 and the infeed roller 331 sandwich and feed the recording medium 10, and the feed nip roller 336 and the outfeed roller 335 sandwich and feed the recording medium 10.

The rear-surface application unit 33 includes a squeeze roller 337, an application roller 338, and a pressing roller 339. After the recording medium 10 is fed to the rear-surface application unit 33, the recording medium 10 is sandwiched and fed between the application roller 338 and the pressing roller 339.

In this case, the preprocessing liquid is supplied to the application roller 338 from the squeeze roller 337, so that the application roller 338 applies the preprocessing liquid onto the one surface (i.e., the rear surface) side of the recording medium 10. The recording medium 10 having passed through the rear-surface application unit 33 is fed to the front-surface application unit 34.

The front-surface application unit 34 includes a squeeze roller 347, an application roller 348, and a pressing roller 349, and applies the preprocessing liquid onto the other surface (i.e., the front surface) side of the recording medium 10. The recording medium 10 having passed through the front-surface application unit 34 is fed to the recording medium heating apparatus (heating unit) 350 which is a heating apparatus by the outfeed roller 335 and the feed nip roller 336.

Here, the rear-surface application unit 33 and the front-surface application unit 34 are controlled so as to be selectively operated. Namely, the preprocessing liquid is applied to either one (i.e., one surface (i.e., the rear surface) or the other surface (i.e., the front surface)) or both surfaces of the recording medium 10.

The preprocessing liquid supplying unit 340 stores the preprocessing liquid and supplies the preprocessing liquid to the rear-surface application unit 33 and the front-surface application unit 34.

The recording medium heating apparatus (heating unit) 350 is an example of the recording medium heating apparatus, and has a configuration similar to that of the recording medium heating apparatus 120 according to an embodiment. Namely, the recording medium heating apparatus (heating unit) 350 heats the recording medium 10 to dry the preprocessing liquid applied onto the recording medium 10.

Here, the same reference numerals are used to describe the elements having substantially the same functions as those of the elements of the recording medium heating apparatus 120, and repeated descriptions thereof may be omitted.

The recording medium heating apparatus (heating unit) 350 has the same configuration of that of the recording medium heating apparatus 120 and includes the heat rollers 40*a*, 40*b*, 50*a*, 50*b* 60*a*, and 60*b* and the control apparatus 80 from the upstream side in the feed direction 20 of the recording medium 10.

Further, in the recording medium heating apparatus (heating unit) 350 as well, the control apparatus 80 performs the control process (see FIG. 3), so as to control the amounts of heat (i.e., temperatures) of the heaters 41*a*-61*b* of the heat rollers 40*a*-60*b*.

The recording medium 10 is sequentially fed between the heat rollers 40*a*-60*b* in a zigzag manner, and fed into the recording medium heating apparatus (heating unit) 350 by the outfeed roller 335, the feed nip roller 336, a feed roller 359, and a feed nip roller 360.

The heat rollers 40*a*-60*b* rotate in accordance with the fed recording medium 10 to heat the recording medium 10 thereby drying the preprocessing liquid applied onto the recording medium 10.

Further, in the recording medium heating apparatus (heating unit) 350, the heat rollers 40*a*-60*b* rotate in accordance with the fed recording medium 10. Therefore, it is not necessary to provide, for example, a motor as a driving unit to drive the rotation of the heat rollers 40*a*-60*b*. As a result, it becomes possible to reduce space necessary for disposing a motor or the like.

The recording medium 10 whose preprocessing liquid applied on the surfaces thereof is dried in the recording medium heating apparatus (heating unit) 350 is sandwiched between the feed roller 359 and a feed nip roller 360 which are driven to rotate, so that the recording medium 10 is fed to a dancer unit 380.

The dancer unit 380 includes two guide rollers 381 and 382, a movable frame 384, a detection unit (not shown) to detect the position of the movable frame 384, and two dancer rollers 385 and 386 rotatably provided on the movable frame 384. The movable frame 384 includes a weight 383 on the lower part thereof, so as to be moved along with the dancer rollers 385 and 386 in the arrow A direction. The recording medium 10 is fed around the guide rollers 381 and 382 and the dancer rollers 385 and 386 in a W shape.

The dancer unit 380 controls the feeding amount of the feed roller 359 based on the output from the detection unit (not shown), so as to adjust the position of the movable frame 384 in the up and down direction. By adjusting the position of the movable frame 384, it becomes possible to ensure the buffer between the preprocessing apparatus 220 and the first inkjet printer 230 disposed in the downstream side of the preprocessing apparatus 220.

The recording medium 10 heated by the recording medium heating apparatus (heating unit) 350 is cooled by the dancer unit 380 and fed to the first inkjet printer 230 disposed on the downstream side.

By having the configuration described above, in the preprocessing apparatus 220, the preprocessing liquid application apparatus (preprocessing liquid application unit) 330 applies the preprocessing liquid to the recording medium so as to improve the image quality by, for example, preventing the occurrence of ink blur and assisting with ink penetration.

After that, the recording medium heating apparatus (heating unit) 350 dries the preprocessing liquid and the dancer unit 380 cools the recording medium 10. Then, the recording medium 10 is fed to the first inkjet printer 230.

Further, the preprocessing liquid application apparatus (preprocessing liquid application unit) 330 serves as a preprocessing unit that applies the preprocessing liquid onto the front surface, the rear surface, or both surfaces of the recording medium 10. The heating unit (recording medium heating apparatus) 350 corresponds to a preprocessing liquid drying apparatus that evaporates the preprocessing liquid.

The preprocessing apparatus 220 having such a configuration applies the preprocessing liquid onto the recording medium 10 so as to improve the image quality by, for example, preventing the occurrence of ink blur and assisting with ink penetration. The preprocessing apparatus 220 applies the preprocessing liquid onto the front surface, or the rear surface, or both surfaces of the recording medium 10.

Further, the control apparatus 80 controls the heaters 41*a*-61*b* so that a total amount of heat W (=amount of heat W1+amount of heat W2+amount of heat W3) is greater than an amount of heat that is sufficient to evaporate water (moisture) of the preprocessing liquid applied onto the recording medium 10.

Further, the control apparatus 80 changes the setting temperatures T1, T2, and T3 (i.e., amounts of heat supplied from the heat rollers to the recording medium 10) based on the feeding speed, the type of the recording medium 10 (i.e., the sheet type), the applied amount of the preprocessing liquid (e.g., an application pattern such as a double-sided application or an single-sided application) or the like.

Table 1 illustrates the relationships amongst the conditions, which are determined based on the feeding speed, the sheet type, and the application amount of the preprocessing apparatus; the first setting temperature T1 of the first rear-surface heat roller 40*a* and the first front-surface heat roller 40*b*; the second setting temperature T2 of the second rear-surface heat roller 50*a* and the second front-surface heat roller 50*b*; and the third setting temperature T3 of the third rear-surface heat roller 60*a* and the third front-surface heat roller 60*b*.

TABLE 1

| CONDITIONS | | | HEAT ROLLER SETTING TEMPERATURES [° C.] | | |
|---|---|---|---|---|---|
| FEEDING SPEED [m/min] | SHEET TYPE | APPLICATION AMOUNT OF PREPROCESSING LIQUID | FIRST SETTING TEMPERATURE T1 | SECOND SETTING TEMPERATURE T2 | THIRD SETTING TEMPERATURE T3 |
| 50 | COATED SHEET A | PATTERN A | 50 | 65 | 80 |
| 30 | COATED SHEET A | PATTERN B | 40 | 50 | 60 |
| 50 | COATED SHEET B | PATTERN A | 60 | 75 | 90 |
| 30 | COATED SHEET B | PATTERN B | 50 | 60 | 70 |
| 50 | COATED SHEET C | PATTERN A | 90 | 105 | 120 |
| 30 | COATED SHEET C | PATTERN B | 80 | 90 | 100 |

As shown in Table 1, in a first case where the feeding speed is 50 m/min, the recording medium 10 is a coat sheet A, and the application amount of the preprocessing apparatus is indicated as a pattern A, the first setting temperature T1, the second setting temperature T2, and the third setting temperature T3 are set to 50° C., 65° C., and 80° C., respectively (i.e., T1=50° C., T2=65° C., and T3=80° C.).

Further, in a second case where the feeding speed is 30 m/min slower than the first case, the recording medium 10 is coat sheet A, and the application amount of the preprocessing apparatus is indicated as a pattern B which is less than pattern A, the first setting temperature T1, the second setting temperature T2, and the third setting temperature T3 are set to 40° C., 50° C., and 60° C., respectively (T1=40° C., T2=50° C., and T3=60° C.). Namely, the setting temperatures T1, T2 and T3 are lower than the corresponding temperatures in the case where the feeding speed is higher than the second case.

Further, in a third case where the feeding speed is 50 m/min, the recording medium 10 is a coat sheet B, and the application amount of the preprocessing apparatus is indicated as pattern A, the first setting temperature T1, the second setting temperature T2, and the third setting temperature T3 are set to 60° C., 75° C., and 90° C., respectively (T1=60° C., T2=75° C., and T3=90° C.). Namely, the setting temperatures T1, T2 and T3 are higher than the corresponding temperatures in the case where the sheet type is sheet A.

Further, in a fourth case where the feeding speed is 30 m/min, the recording medium 10 is coat sheet B, and the application amount of the preprocessing apparatus is indicated as pattern B, the first setting temperature T1, the second setting temperature T2, and the third setting temperature T3 are set to 50° C., 60° C., and 70° C., respectively (T1=50° C., T2=60° C., and T3=70 t). Namely, the setting temperatures T1, T2 and T3 are lower than the corresponding temperatures in the case where the feeding speed is higher than the fourth case.

Further, in a fifth case where the feeding speed is 50 m/min, the recording medium 10 is a coat sheet C, and the application amount of the preprocessing apparatus is indicated as pattern A, the first setting temperature T1, the second setting temperature T2, and the third setting temperature T3 are set to 90° C., 105° C., and 120° C., respectively (T1=90° C., T2=105° C., and T3=120° C.). Namely, the setting temperatures T1, T2 and T3 are higher than the corresponding temperatures in the case where the sheet type is A or B.

Further, in a sixth case where the feeding speed is 30 m/min, the recording medium 10 is coat sheet C, and the application amount of the preprocessing apparatus is indicated as pattern B, the first setting temperature T1, the second setting temperature T2, and the third setting temperature T3 are set to 80° C., 90° C., and 100° C., respectively (T1=80° C., T2=90° C., and T3=100° C.). Namely, the setting temperatures T1, T2 and T3 are lower than the corresponding temperatures in the case where the feeding speed is higher than the sixth case.

Further, it should be noted that the values of the above setting temperatures are examples only, and the present invention is not limited to the invention based on these values. Further, the setting temperatures are appropriately set based on, for example, experiments.

The recording medium 10 on which the preprocessing liquid is applied by the preprocessing liquid application unit 330 is fed to the recording medium heating apparatus (heating unit) 350 by the supply feed roller 30. The recording medium 10 fed to the supply feed roller 30 is in first contact with and heated by the first rear-surface heat roller 40*a* of the first heat roller set 40 that is controlled to have the first setting temperature T1 by the control apparatus 80. After that, the recording medium 10 is in contact with and heated by the first front-surface heat roller 40*b* that is similarly controlled to have the first setting temperature T1.

Then, the recording medium 10 is in contact with and heated by the second rear-surface heat roller 50*a* of the second heat roller set 50 that is controlled to have the second setting temperature T2 by the control apparatus 80. After that, the recording medium 10 is in contact with the second front-surface heat roller 50*b* that is similarly controlled to have the first setting temperature T2 to be heated.

In the same manner, the recording medium 10 is in contact with and heated by the third rear-surface heat roller 60*a* of the third heat roller set 60 that is controlled to have the third setting temperature T3 by the control apparatus 80. After that, the recording medium 10 is in contact with and heated by the third front-surface heat roller 60*b* that is similarly controlled to have the first setting temperature T3.

By doing this, the moisture (water) of the preprocessing liquid applied to the recording medium 10 is evaporated in accordance with the heat applied by the first heat roller set 40 and the second heat roller set 50. Further, due to the heat applied by the third heat roller set 60, the moisture of the preprocessing liquid on the recording medium 10 is evaporated so that the moisture is less than or equal to a corresponding predetermined value. After that, the recording medium 10 is discharged from the recording medium heating apparatus (heating unit) 350 by the discharge feed roller 70.

Therefore, the recording medium 10 is in first contact with the first heat roller set 40 whose temperature is the first setting temperature T1 that is the lowest among the first heat roller set 40, the second heat roller set 50, and the third heat roller set 60. By doing this, it becomes possible to reduce the temperature difference between the recording medium 10 and the heat roller(s) with which the recording medium 10 is in first contact.

Accordingly, when compared with a case where the temperature of all the heat rollers is set to the third setting temperature T3 which is the highest temperature, it becomes possible to prevent a sudden temperature increase of the recording medium 10. Namely, it becomes possible for the system 200 to minimize a thermal load applied to the recording medium 10. Also, it become possible for the system 100 to reduce the occurrence of damage (i.e., wrinkles, deformation and the like) to the recording medium 10 due to the thermal load.

Further, as described above, the third heat roller set 60 supplies heat to the recording medium 10 sufficient to evaporate the moisture of preprocessing liquid so that the moisture of the preprocessing liquid is less than or equal to the predetermined value. Therefore, it becomes possible for the system 200 to ensure drying of the preprocessing liquid applied to the recording medium 10 so as to prevent the blurring of ink used in printing an image onto the recording medium and assist the ink's penetration to improve the printing quality of image information formed on the recording medium 10.

Further, in the second embodiment, a case is described where the control apparatus 80 controls the heaters 41*a*-61*b* so that the temperatures of the heat roller sets 40, 50, and 60 are set to the corresponding setting temperatures. However, for example, the control apparatus 80 may control the heaters 41*a*-61*b* so that the setting temperatures of the heat rollers 40*a*, 40*b*, 50*a*, 50*b*, 60*a*, and 60*b* (heat rollers 40*a*-60*b*) are different from each other. In this case, the control apparatus 80 controls the heaters 41*a*-61*b* so that the setting temperature of the heat rollers 40*a*-60*b* is gradually increased in the direction from the upstream side to the downstream side.

By doing this, it may become possible for the system 200 to effectively reduce the heat load applied to the recording medium 10. As a result, it becomes possible to effectively prevent the occurrence of damage (e.g., wrinkles and deformation) to the recording medium due to the heat load.

Third Embodiment

Figure 9:
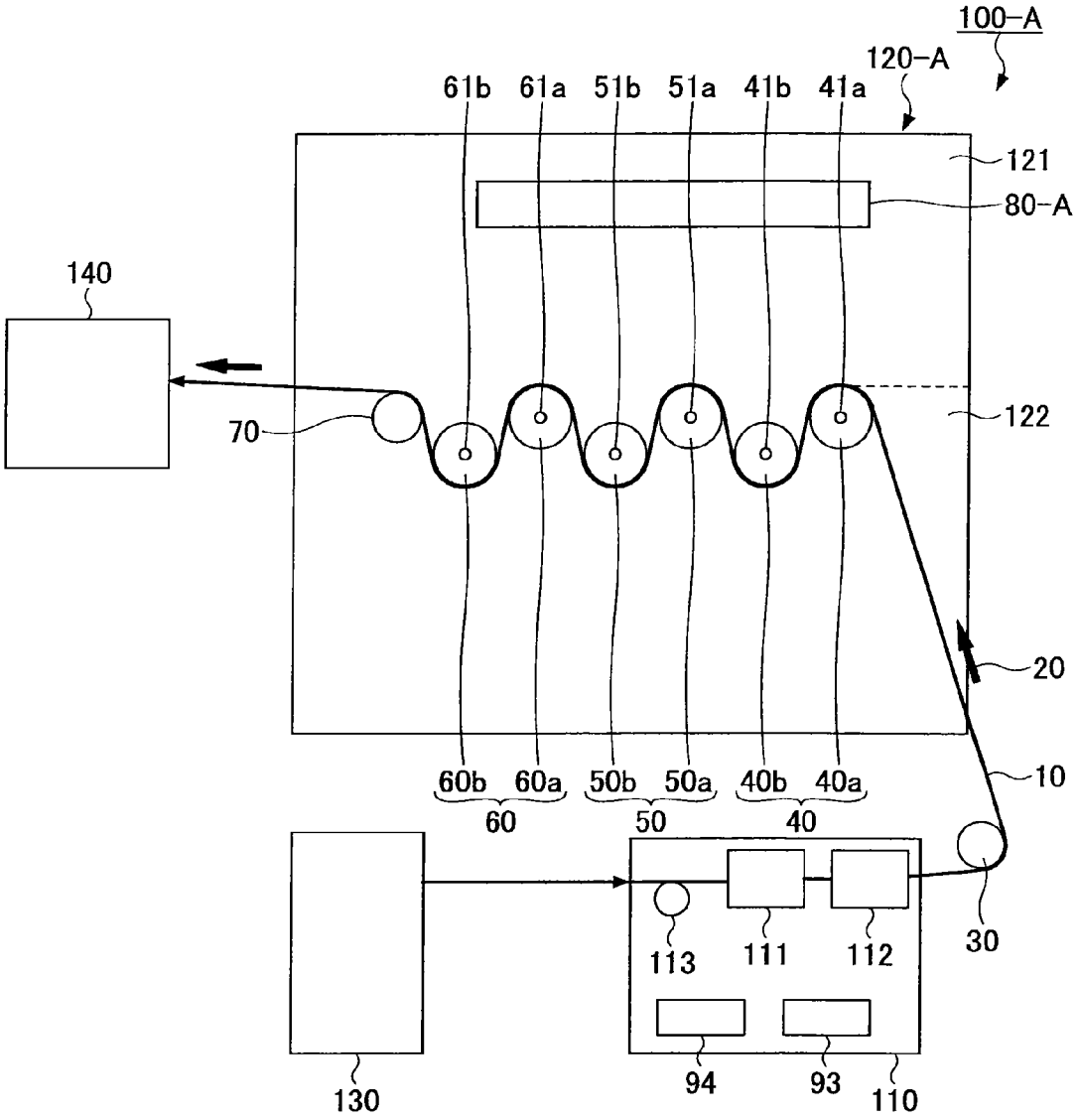
FIG. 9 schematically illustrates an example of a system including a recording medium heating apparatus according to a third embodiment of the present invention.

Next, a system (printing system) 100-A including a recording medium heating apparatus (ink drying apparatus) 120-A according to a third embodiment is described. FIG. 9 schematically illustrates a configuration of the overall system including the recording medium heating apparatus (ink drying apparatus) 120-A. In the following, the same reference numerals are used to describe the same elements in the first embodiment, and the elements different from those in the first embodiment are mainly described.

As illustrated in FIG. 9, in the system (printing system) 100-A, there is a sheet supplying apparatus 130 disposed on the upstream side of the recording apparatus 110. Also, a winding apparatus 140 is disposed on the downstream side of the recording medium heating apparatus (ink drying apparatus) 120-A. Instead of the winding apparatus 140, a folding machine to fold the printed recording material 10 may be disposed.

The recording apparatus 110 includes a front-surface image forming unit 111, a rear-surface image forming unit 112, a feeding section 113, an image forming controlling section 93, and a feeding control section 94. In the recording apparatus 110, the front-surface image forming unit 111 and the rear-surface image forming unit 112, which may be, for example, a inkjet head section, form an image on the recording medium 10 by discharging liquid such as ink onto the recording medium 10.

The recording medium heating apparatus (ink drying apparatus) 120-A includes the first heat roller set 40, the second heat roller set 50, and the third heat roller set 60, the discharge feed roller 70, and a control apparatus 80-A. The first heat roller set 40 includes the first rear-surface heat roller 40*a* and the first front-surface heat roller 40*b*.

The second heat roller set 50 includes the second rear-surface heat roller 50*a* and the second front-surface heat roller 50*b*. The third heat roller set 60 includes the third rear-surface heat roller 60*a* and the third front-surface heat roller 60*b*. The control apparatus 80-A controls the heat rollers 40*a*-60*b* and the discharge feed roller 70.

Figure 10:
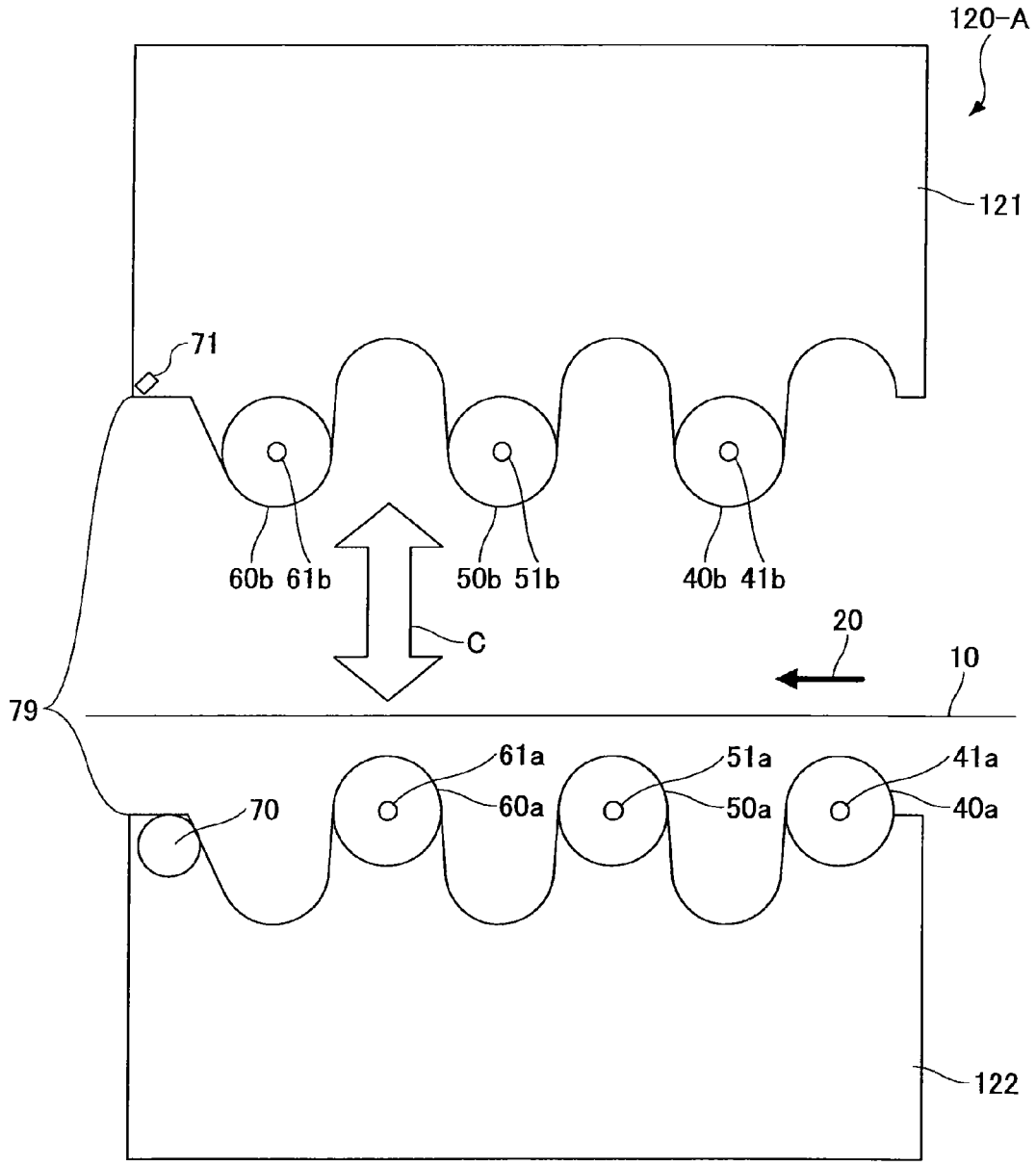
FIG. 10 is an exploded view of the heating apparatus of FIG. 4 in an open state.

FIG. 10 is an exploded view of the recording medium heating apparatus (ink drying apparatus) 120-A in its open state. As illustrated in FIG. 10, there is a front-surface heating unit 121, which includes the first front-surface heat roller 40*b*, the second front-surface heat roller 50*b*, and the third front-surface heat roller 60*b*, on the upper side of the ink drying apparatus (heating apparatus) 120-A.

On the other hand, there is a rear-surface heating unit 122, which includes the first rear-surface heat roller 40*a*, the second rear-surface heat roller 50*a*, the third rear-surface heat roller 60*a*, and the discharge feed roller 70 on the lower side of the ink drying apparatus (heating apparatus) 120-A. Further, there is formed an outlet 79 of the ink drying apparatus (heating apparatus) 120-A, and there is an outlet sensor 71 disposed near the outlet 79. Further, the control apparatus 80-A and the outlet sensor 71 may be disposed in either the front-surface heating unit 121 or the rear-surface heating unit 122.

During the feeding of the recording medium 10, the rear surface (the other surface) of the recording medium 10 facing downward is in contact with the first rear-surface heat roller 40*a*, the second rear-surface heat roller 50*a*, and the third rear-surface heat roller 60*a*.

Further, the front surface (one surface) of the recording medium 10 facing upward is in contact with the first front-surface heat roller 40*b*, the second front-surface heat roller 50*b*, and the third front-surface heat roller 60*b*.

Further, FIG. 10 illustrates the open state where the front-surface heating unit 121 and the rear-surface heating unit 122 are separated from each other in the arrow C direction (i.e., in the up-and-down direction). When the recording medium 10 is loaded (placed), the recording medium 10 is fed between the front-surface heating unit 121 and the rear-surface heating unit 122 in this open state.

After the recording medium 10 is passed between the front-surface heating unit 121 and the rear-surface heating unit 122, the front-surface heating unit 121 and the rear-surface heating unit 122 are moved so as to approach each other to be in contact with each other via the recording medium ("closed state") as shown in FIG. 9.

By doing this, it be easy to load (place) the recording medium to be fed in the feed direction (arrow 20) between the rear-surface heating unit 122, the front-surface heating unit 121 and the rear-surface heating unit 122 in the ink drying apparatus (heating apparatus) 120-A.

Figure 11:
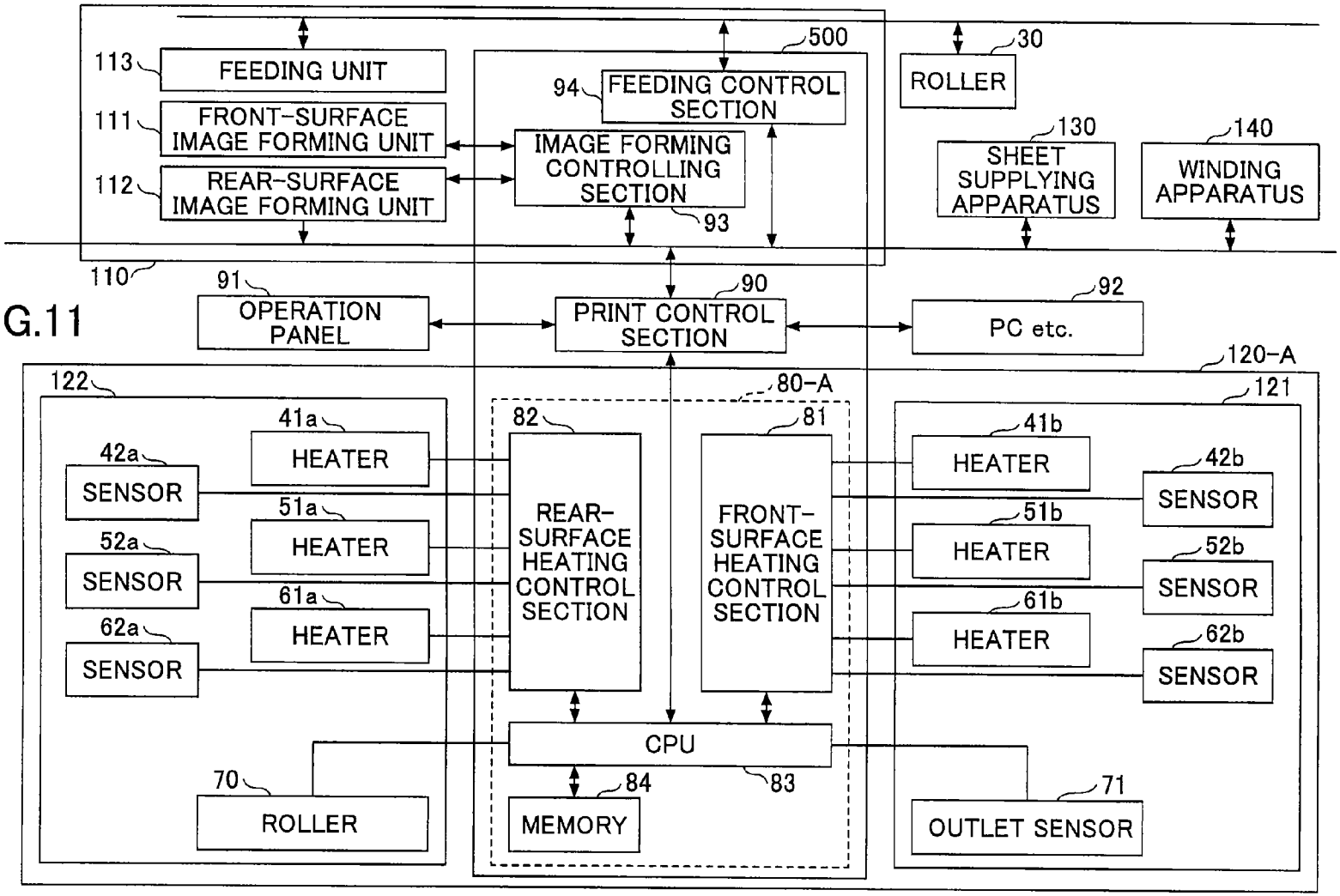
FIG. 11 is an example of a control block diagram of the system in FIG. 9.

FIG. 11 is a block diagram of the system including the ink drying apparatus (heating apparatus) 120-A. As illustrated in FIG. 11, the control apparatus 80-A of the ink drying apparatus (heating apparatus) 120-A is included in a control system 500 of the printing system) 100-A.

The control apparatus 80-A of the ink drying apparatus (heating apparatus) 120-A includes a front-surface heating control section 81, a rear-surface heating control section 82, a CPU 83, and a memory 84.

Although not being illustrated, the control apparatus 80-A further includes a RAM and a ROM storing a program to be executed for heating, an I/O (input section) which controls the input and output of an electric component such as a sensor, and an I/F (interface section) for receiving data from a print control section 90.

The control system 500 of the system (printing system) 100-A includes the ink drying apparatus (heating apparatus) 120-A, the control apparatus 80-A, the print control section 90, which controls the recording apparatus 110, the image forming controlling section 93 and the feeding control section 94.

Further, the print control section 90 is connected to an operation panel 91, a personal computer (including a server or the like) 92, the sheet supplying apparatus 130, and the winding apparatus 140 via plural data lines and control lines, so as to perform control on overall operations including ink drying.

The print control section 90 performs, for example, a raster image processor (RIP) process in accordance with the print job data supplied from a host apparatus and generates bit map data for each of certain colors of the print image data. Also, the print control section 90 generates control information for controlling printing operations based on the print job data and the information of the host apparatus. The print control section 90 may be provided in the recording apparatus 110.

In the recording apparatus 110, the image forming controlling section 93 connected to the print control section 90 controls the front-surface image forming unit 111 and the rear-surface image forming unit 112. Further, the feeding control section 94 is connected to the supply feed roller 30 and the discharge feed roller 70, which are connected to the ink drying apparatus (heating apparatus) 120-A, and control the feeding of the recording medium 10.

In the control apparatus 80-A of the ink drying apparatus (heating apparatus) 120-A, the CPU 83 controls the front-surface heating control section 81 and the rear-surface heating control section 82.

In the control apparatus 80-A, the front-surface heating control section 81 is connected to the temperature sensors 42*b*, 52*b*, and 62*b* which detect the temperatures of the heat rollers 40*b*, 50*b*, and 60*b*, respectively, and the heaters 41*b*, 51*b*, and 61*b* in the front-surface heating unit 121. Also, the rear-surface heating control section 82 is connected to the temperature sensors 42*a*, 52*a*, and 62*a* which detect the temperatures of the heat rollers 40*a*, 50*a*, and 60*a*, respectively, and the heaters 41*a*, 51*a*, and 61*ab* in the rear-surface heating unit 122.

In this embodiment, the control apparatus 80-A monitors an operating state of the front-surface image forming unit 111 and the rear-surface image forming unit 112, and controls the heaters 41*a*-61*b* of the heat rollers 40*a*-60*b* in a manner described below. The control apparatus 80-A controls the heaters 41*a*-61*b* provided in the heat rollers 40*a*-60*b* so that the surface(s) (the front surface, the rear surface, or both) on which ink is applied is dried.

When only the front-surface image forming unit 111 is operated, namely when ink is applied onto only the front surface of the recording medium 10, the front-surface heating control section 81 of the control apparatus 80-A operates the heaters 41*b*, 51*b*, and 61*b* so that the temperatures of the heat rollers 40*b*, 50*b*, and 60*b* are respective setting temperatures. Further, the heat rollers 40*b*, 50*b*, and 60*b* heat and dry the ink only on the front surface side of the recording medium 10.

When only the rear-surface image forming unit 112 is operated, namely when ink is applied onto only the rear surface of the recording medium 10, the rear-surface heating control section 82 operates the heaters 41*a*, 51*a*, and 61*a* so that the temperatures of the heat rollers 40*a*, 50*a*, and 60*a* are respective setting temperatures. Further, the heat rollers 40*a*, 50*a*, and 60*a* heat and dry the ink only on the rear surface side of the recording medium 10.

Further, when both the front-surface image forming unit 111 and the rear-surface image forming unit 112 are operated, namely when ink is applied onto both surfaces of the recording medium 10, the control apparatus 80-A operates the heaters 41*a*-61*b* so that the temperatures of the heat rollers 40*a*-60*b* are respective setting temperatures. Further, the heat rollers 40*a*-60*b* heat and dry ink on both rear and front surfaces of the recording medium 10

Here, when ink is applied on only the front surface or the rear surface, the control apparatus 80-A controls the heaters 41*a*-61*b* so that a moisture content of the recording medium 10 discharged from the ink drying apparatus (heating apparatus) 120-A is substantially equal to the moisture content of the recording medium 10 fed from the sheet supplying apparatus 130.

Further, when only one of the front or rear surface is dried or when the operation of the ink drying apparatus (heating apparatus) 120-A is stopped, the control apparatus 80-A completely turns off the heaters that are not to be operated.

Otherwise, when only one of the front or rear surface is dried, the control apparatus 80-A may operate the heaters that are not to be operated so that the temperatures of the heat rollers on the side of the surface opposite to the surface on which ink is applied of the recording medium 10 are lower than the corresponding temperatures set in the heat rollers that are on the side of the surface on which ink is applied.

For example, the temperatures to be set on the side of the surface to which ink is applied is approximately in a range from 60° C. to 120° C. and the temperatures to be set on the side of the surface to which no ink is applied ("waiting temperature") is approximately in a range from 40° C. to 45° C. When the temperature is higher than 45° C., the recording medium 10 may be thermally deformed, and when the temperature is less than or equal to 40° C., it may not be possible to maintain a temperature-sustaining effect of the heat rollers 40*a*-60*b*. Therefore, temperatures in the range from 40° C. to 45°C. are the optimal waiting temperatures.

The control apparatus 80-A controls the temperatures of the heat rollers 40*a*-60*b* based on the temperatures of the heat rollers 40*a*-60*b* detected by the temperature sensors 42*a*-62*b* and operating states indicating, for example, the rotational speed of the discharge feed roller 70 and/or the supply feed roller 30.

In this case, in the control apparatus 80-A, the rear-surface heating control section 82 collectively controls the heat rollers 40*a*, 50*a*, and 60*a* of the respective heat roller sets as a recording medium rear-surface heat roller group.

Further, the front-surface heating control section 81 collectively controls the heat rollers 40*b*, 50*b*, and 60*b* of the respective heat roller sets as a recording medium front-surface heat roller group. Herein the recording medium rear-surface heat roller group and the recording medium front-surface heat roller group may also be called a "one surface heat roller group" and a "the other surface heat roller group", respectively.

The front-surface heating control section 81 and the rear-surface heating control section 82 control respective heaters 41*a*-61*b* in a manner such that the setting temperatures of the third rear-surface heat roller 60*a* and the third front-surface heat roller 60*b* disposed on the downstream side of the feeding path of the recording medium 10 are higher than the respective setting temperatures of the first rear-surface heat roller 40*a* and the first front-surface heat roller 40*b* disposed on the upstream side of the feeding path.

Figure 12:
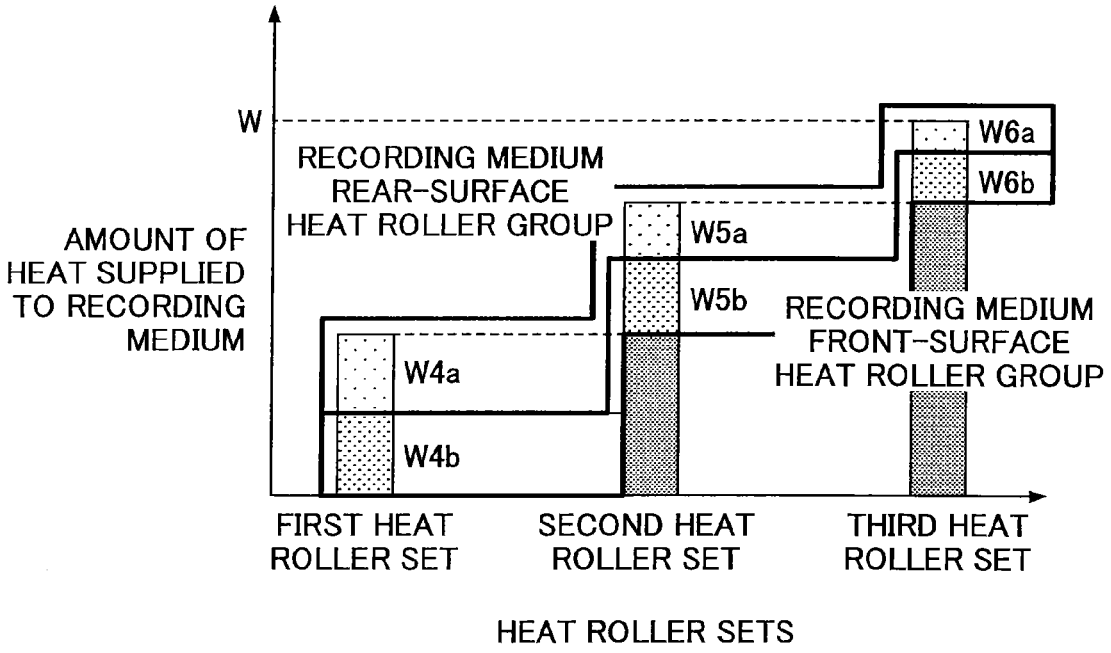
FIG. 12 is an example of a graph illustrating a relationship between the amounts of heat received by a recording medium and the heat roller sets of FIG. 9.

FIG. 12 is a graph illustrating the relationship between the amount of heat received by the recording medium 10 and the heat roller sets. As illustrated in FIG. 12, the rear-surface heating control section 82 controls the heaters 41*a*, 51*a*, and 61*a* of the heat rollers 40*a*, 50*a*, and 60*a* so that the temperatures of the heat rollers 40*a*, 50*a*, and 60*a* of the recording medium rear-surface heat roller group are T4*a*, T5*a*, and T6*a*, respectively.

Further, the front-surface heating control section 81 controls the heaters 41*b*, 51*b*, and 61*b* of the heat rollers 40*b*, 50*b*, and 60*b* so that the temperatures of the heat rollers 40*b*, 50*b*, and 60*b* of the recording medium front-surface heat roller group are T4*b*, T5*b*, and T6*b*, respectively.

Then, the control apparatus 80-A controls the heaters 41*a*-61*b* so that, for example, the setting temperatures of the heat rollers 40*a*-60*b* satisfy the following formula (1).

Relationship of controlled temperatures of heat rollers 40*a*-60*b*

$$T4a \leq T5a \leq T6a \text{ and } T4b \leq T5b \leq T6b \quad (1)$$

In this case, it is also possible that neither the recording medium rear-surface heat roller group 40*a*, 50*a*, and 60*a* nor the recording medium front-surface heat roller group 40*b*, 50*b*, and 60*b* is heated or both of the recording medium rear-surface heat roller group 40*a*, 50*a*, and 60*a* and the recording medium front-surface heat roller group 40*b*, 50*b*, and 60*b* are not heated.

Further, the control apparatus 80-A monitors the temperatures of the heat rollers 40*a*-60*b* and compares the differences between the setting temperatures T4*a*, T5*a*, T6*a*, T4*b*, T5*b*, and T6*b* of the heat rollers 40*a*-60*b* and the corresponding current temperatures. Based on the comparisons, the control apparatus 80-A controls the temperatures of the heat rollers 40*a*-60*b* while anticipating the temperatures after a certain time period.

Otherwise, the control apparatus 80-A may perform two-step (on/off) control by continuing to turn on the heaters 41*a*-61*b* until the temperatures thereof reach the respective setting temperatures and turning off the heaters 41*a*-61*b* when the temperatures thereof reach the respective setting temperatures.

The control apparatus 80-A performs control so that an amount of heat supplied from the first rear-surface heat roller 40*a* of the recording medium rear-surface heat roller group to the recording medium 10 is W4*a*, an amount of heat supplied from the second rear-surface heat roller 50*a* of the recording medium rear-surface heat roller group to the recording medium 10 is W5*a*, and an amount of heat supplied from the third rear-surface heat roller 60*a* of the recording medium rear-surface heat roller group to the recording medium 10 is W6*a*.

In the same manner, the control apparatus 80-A performs control so that an amount of heat supplied from the first front-surface heat roller 40*b* of the recording medium front-surface heat roller group to the recording medium 10 is W4*b*, an amount of heat supplied from the second front-surface heat roller 50*b* of the recording medium front-surface heat roller group to the recording medium 10 is W5*b*, and an amount of heat supplied from the third front-surface heat roller 60*b* of the recording medium rear-surface heat roller group to the recording medium 10 is W6*b*.

In this case, the control apparatus 80-A controls the heaters 41*a*-61*b* so that a total amount of heat W which is the sum of an amount of heat Wa, which corresponds to the heating the rear surface, and an amount of heat Wb, which corresponds to the heating the front surface, exceeds an amount of heat that is sufficient to evaporate the solvent included in the ink on the recording medium 10 at a desired degree.

$$Wa(=\text{total amount of heat } W4a+W5a+W6a)+Wb(=\text{total amount of heat } W4b+W5b+W6b)>\text{amount of heat sufficient to evaporate(minimum required heat for evaporation)} \quad (2)$$

Further, the amount of heat supplied from the heat rollers 40*a*-60*b* to the recording medium varies depending on the time period while the recording medium 10 is in contact with the heat rollers 40*a*-60*b* (i.e., feeding speed of the recording medium). Therefore, the control apparatus 80-A changes the setting temperatures based on the rotational speed of the discharge feed roller 70 and/or the supply feed roller 30.

The recording medium on which ink is applied by the front-surface image forming unit 111 and the rear-surface image forming unit 112 of the recording apparatus 110 is fed to the ink drying apparatus (heating apparatus) 120-A by the supply feed roller 30. The rear surface of the recording medium 10 fed into the ink drying apparatus (heating apparatus) 120-A is heated by the heat rollers 40*a*, 50*a*, and 60*a* of the recording medium rear-surface heat roller group at the temperatures T4*a*, T5*a*, and T6*a*, respectively, controlled by the rear-surface heating control section 82.

Similarly, the front surface of the recording medium 10 fed into the ink drying apparatus (heating apparatus) 120-A is heated by the heat rollers 40*b*, 50*b*, and 60*b* of the recording medium front-surface heat roller group at the temperatures T4*b*, T5*b*, and T6*b*, respectively, controlled by the front-surface heating control section 81.

Further, the solvent component of the ink printed on the recording medium 10 is evaporated in accordance with the heat applied by the first heat roller set 40 and the second heat roller set 50. Further, due to the heat applied by the third heat roller set 60, the solvent component of the ink printed on the recording medium 10 is further evaporated so that the solvent component is less than or equal to a corresponding predetermined value. After that, the recording medium 10 is discharged from the ink drying apparatus (heating apparatus) 120-A by the discharge feed roller 70.

Figure 13:
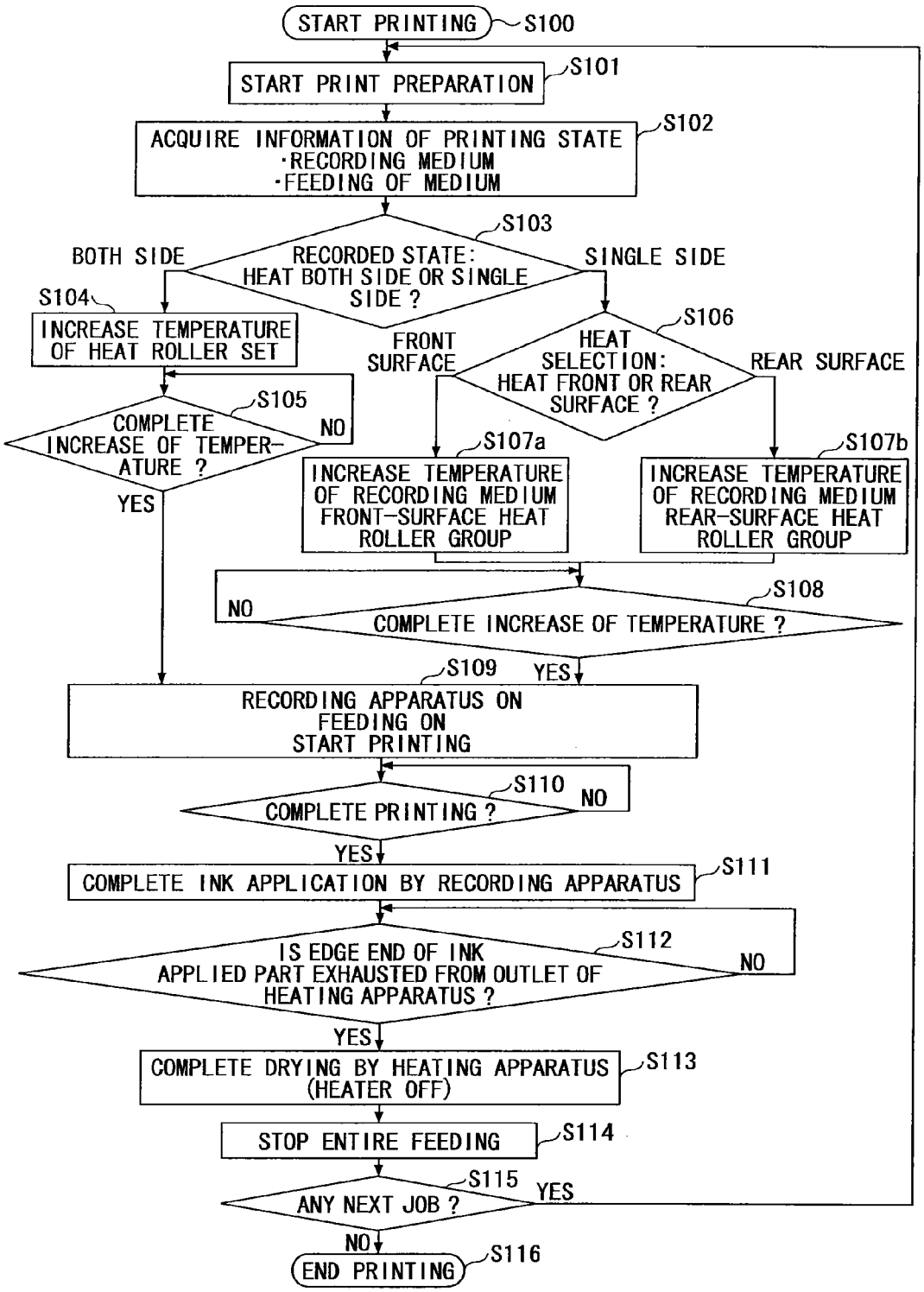
FIG. 13 is an example of a flowchart of operations of the system in FIG. 11.

Next, operations of the system (printing system) 100-A are described with reference to a flowchart in FIG. 13. In FIG. 13, when an instruction to start printing is issued from the operation panel 91 or the personal computer (including a server or the like) 92 (step S100), the system (printing system) 100-A system starts the preparations for the printing (step S101).

In this case, the print control section 90 recognizes (receives) the information items from the operation panel 91 or the personal computer (including a server or the like) 92, the information items indicating the printing state, the recording medium, and the feeding of the recording medium, which are used for determining the setting temperatures of the heat rollers 40*a*-60*b* (step S102). The information indicating the printing state refers to the information indicating whether the printing is single-sided printing, rear-side printing, or double-sided printing.

The information indicating the recording medium refers to the information indicating, for example, the type (e.g., ordinary sheet, coated sheet or the like), the width, or the weight of the recording medium. The information indicating the feeding of the recording medium refers to the information indicating, for example, the feeding speed, the feeding amounts (corresponding number of pages).

Next, the print control section 90 further recognizes the information of the recording apparatus 110 from the operation panel 91 or the personal computer (including a server or the like) 92, the information indicating whether data (image) are recorded on the recording medium 10. When data are recorded, the print control section 90 further recognizes, for example, the recording surface(s) (i.e., single-sided or double-sided, and the front surface or the rear surface in case of single-sided).

The information items recognized by the print control section 90 are classified by the control apparatus 80-A of the ink drying apparatus (heating apparatus) 120-A into two cases: one is a case of double-sided printing where it is necessary to heat both sides (i.e., the front surface and the rear surface) of the recording medium 10, and the other is a case of single-sided printing where it is necessary to heat one side of the recording medium 10 (step S103).

In the case where it is necessary to heat both surfaces of the recording medium 10, for example, the control apparatus 80-A causes the heaters 41*a*-61*b* of the heat rollers 40*a*-60*b* to operate to have the heat roller setting temperatures determined based on the printing state as shown in Table 1. By doing this, the temperatures of the ink drying apparatus (heating apparatus) 120-A are increased (step S104).

Based on the output of the temperature sensors 42*a*-62*b*, the control apparatus 80-A determines whether the heat rollers 40*a*-60*b* are heated up to the respective setting temperatures (step S105).

Further, when it is necessary to heat only one surface of the recording medium 10 in step S103, the CPU 83 of the control apparatus 80-A determines which of the recording medium rear-surface heat roller group 40*a*, 50*a*, and 60*a* and the recording medium front-surface heat roller group 40*b*, 50*b*, and 60*b* is to be heated (step S106).

Further, the control apparatus 80-A causes the heaters 41*a*-61*b* of the heat rollers 40*a*-60*b* to operate to heat in accordance with the relationship as shown in Table 1 previously determined based on the printing state and increases the temperatures of the heaters 41*a*-61*b* (ink drying apparatus (heating apparatus) 120-A) (steps S107*a* and S107*b*).

Next, based on the output of the temperature sensors 42*a*-62*b*, the control apparatus 80-A determines whether the temperatures of the heat rollers 40*a*-60*b* reach the respective setting temperatures (step S108).

Then, when the temperatures of the heat rollers 40*a*-60*b* reach the respective setting temperatures (YES in step S105 or S108), the print control section 90 drives the sheet supplying apparatus 130, the feeding section 113, the supply feed roller 30, and the discharge feed roller 70 via the feeding control section 94 to feed the recording medium 10. In this case, the front-surface image forming unit 111 and the rear-surface image forming unit 112 of the recording apparatus 110 operate to discharge ink onto the recording medium 10 to start printing operation (step S109).

Next, the control system 500 determines whether printing in the recording apparatus 110 is finished (step S110).

After printing finishes (step S111), the control system 500 determines whether the edge end of the part where ink is applied on the recording medium 10 is discharged from the ink drying apparatus (heating apparatus) 120-A (step S112). The determination whether the edge end of the part where ink is applied on the recording medium 10 is discharged from the ink drying apparatus (heating apparatus) 120-A is made based on ink discharge timings of the front-surface image forming unit 111 and the rear-surface image forming unit 112 and the statuses of the feeding sections such as the supply feed roller 30, and the discharge feed roller 70.

For example, the determination may be made by calculating a required time period based on the feeding distance and the feeding speed of the recording medium 10 and comparing the required time period and a result of counting the time.

When the edge end of the part where ink is applied on the recording medium 10 is discharged from the outlet 79 of the ink drying apparatus (heating apparatus) 120-A, the control apparatus 80-A turns off the operating heaters 41*a*-61*b* of the heat rollers 40*a*-60*b* to stop the ink drying apparatus (heating apparatus) 120-A (step S113).

After that, the feeding control section 94 of the control system 500 stops driving the sheet supplying apparatus 130, the feeding section 113, the supply feed roller 30, and the discharge feed roller 70, so as to stop the ink drying apparatus (heating apparatus) 120-A (step S114).

Then, the print control section 90 of the control system 500 determines whether there is the next job (step S115). When there is the next job, the process goes back to step S101 to start preparing for the printing. When there is no next job, the process ends (step S116).

According to the control described above, the recording medium 10 is in contact with the first heat roller set 40 whose temperature is the first setting temperature T1 which is the lowest among the first heat roller set 40, the second heat roller set 50, and the third heat roller set 60. By doing this, it becomes possible to reduce the temperature difference between the recording medium 10 and the heat roller(s) with which the recording medium 10 is in first contact.

Accordingly, when compared with a case where the temperature of all the heat rollers is set to the third setting temperature T3 which is the highest temperature, it becomes possible to prevent a sudden temperature increase of the recording medium 10. Namely, it becomes possible for the system 100-A of the ink drying apparatus (heating apparatus) 120-A to minimize a thermal load applied to the recording medium 10. Also, it become possible for the system 100-A to reduce the occurrence of damage (i.e., wrinkles, deformation and the like) to the recording medium 10 due to the lower thermal load.

In this third embodiment as well, the third heat roller set 60 supplies heat to the recording medium 10 sufficient to evaporate moisture in ink so that the moisture in the ink is less than or equal to a corresponding predetermined value. Therefore, it becomes possible for the system 100-A to improve the printing quality of image information formed on the recording medium 10.

Further, the ink drying apparatus (heating apparatus) 120-A controls each of the heaters 41*a*-61*b* based on the type of the recording medium 10 (e.g., type of the sheet) and the printing mode (e.g., whether printing is performed on one of the front surface and the rear surface or both if the position of the image forming area differs).

By doing this, it becomes possible for the system 100-A to reduce the thermal load to the recording medium 10 when compared with the case where the same control is performed regardless of single-sided printing or double-sided printing. Further, it becomes possible to effectively prevent the occurrence of damage (e.g., wrinkles or deformation) due to thermal load to the recording medium 10, the damage likely to occur especially when the recording medium 10 is a continuous form having an arbitrary length.

Fourth Embodiment

Figure 14:
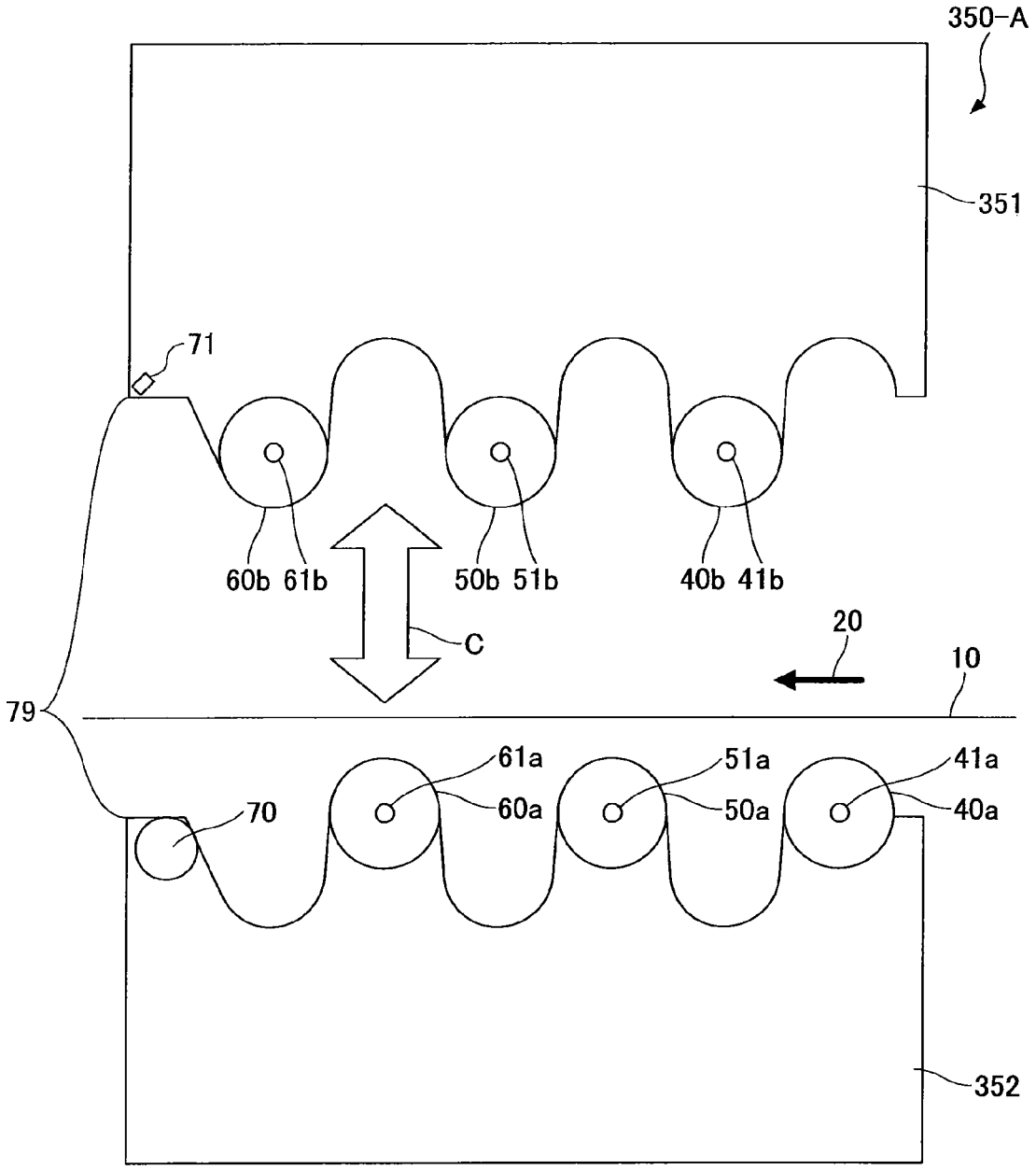
FIG. 14 is an exploded view of an example of a recording medium heating apparatus in an open state according to a fourth embodiment.
Figure 15:
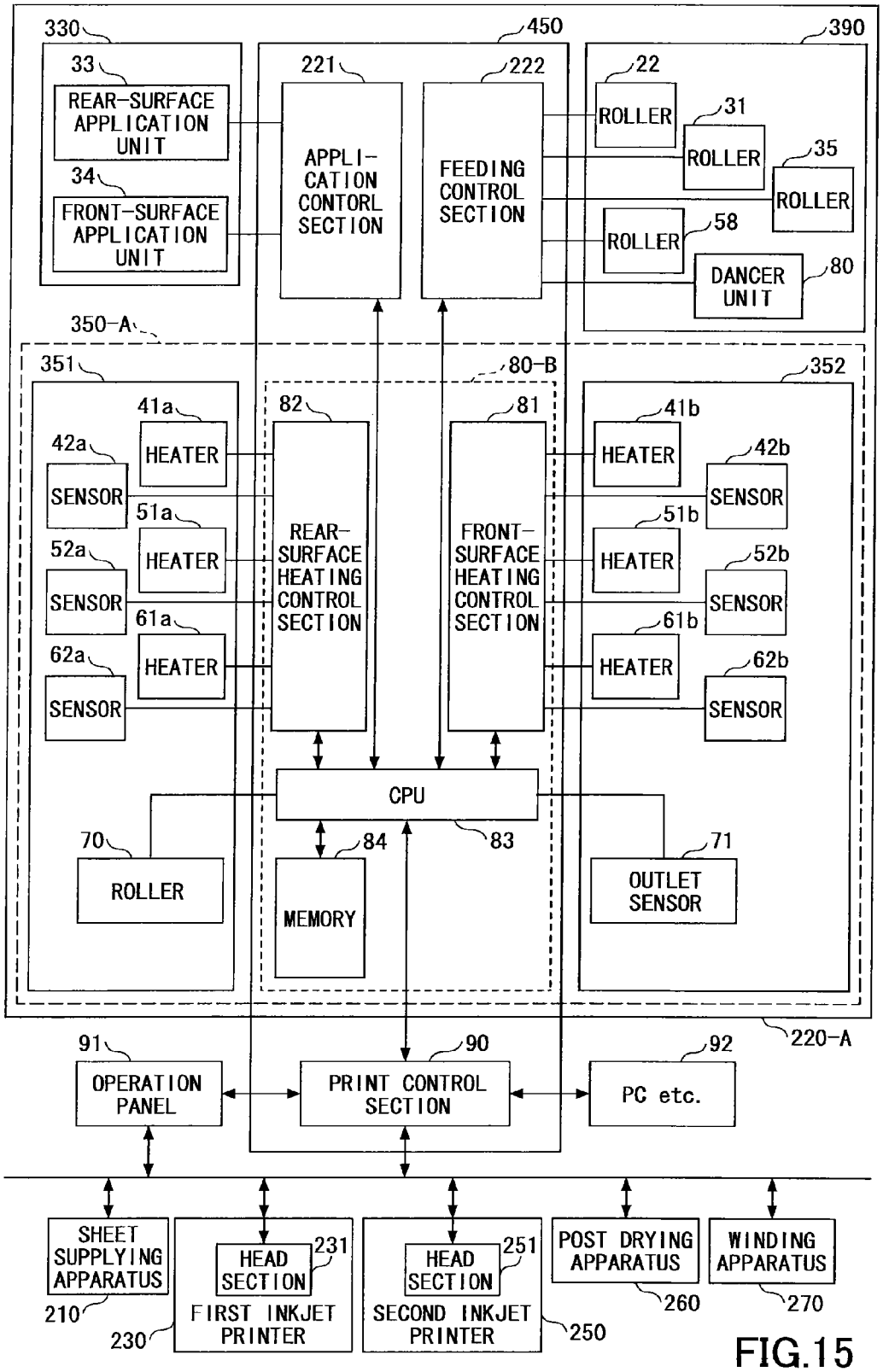
FIG. 15 is an example of a control block diagram of a printing system including a preprocessing apparatus having the heating apparatus of FIG. 14.
Figure 16:
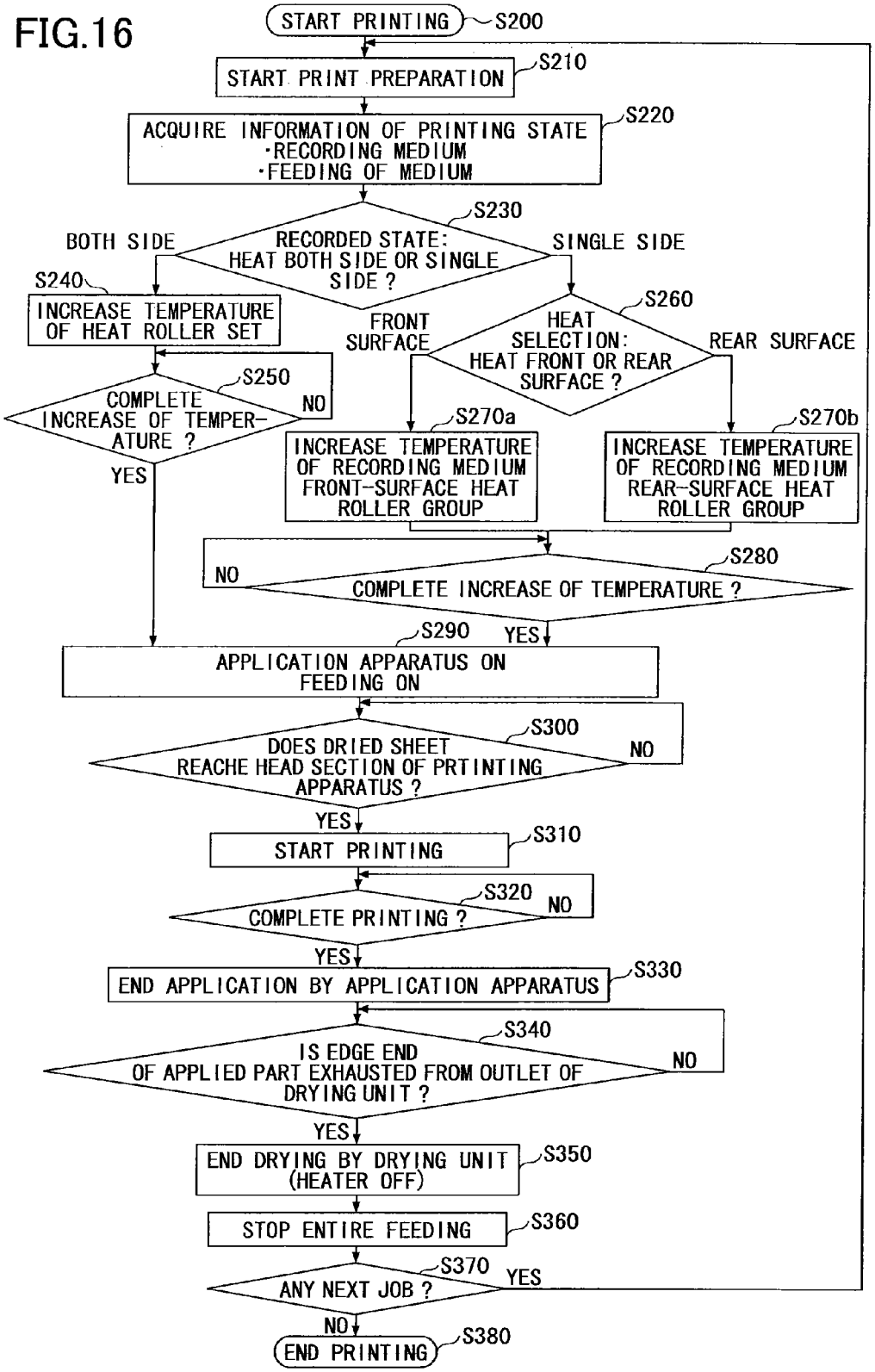
FIG. 16 is an example of a flowchart of operations of the system in FIG. 15.

Next, with reference to FIGS. 14 through 16, a printing system 200-A including a recording medium heating apparatus (heating unit) 350-A according to a fourth embodiment is described. FIG. 14 is an exploded view of the recording medium heating apparatus (heating unit) 350-A in its open state. The configuration of the recording medium heating apparatus (heating unit) 350-A in this embodiment is basically similar to that of the recording medium heating apparatus (heating unit) 350 according to the second embodiment except that a control apparatus 80-A is used in place of the control apparatus 80.

Further, the recording medium heating apparatus (heating unit) 350-A is used in the preprocessing apparatus (preprocessing liquid application and drying apparatus) 220 in FIG. 7 in place of the recording medium heating apparatus (heating unit) 350. Further, a preprocessing apparatus (preprocessing liquid application and drying apparatus) 220-A according to the fourth embodiment is a part of the printing system 200 of FIG. 6.

In this embodiment, a printing system 200-A and the preprocessing apparatus (preprocessing liquid application and drying apparatus) 220-A are provided. In the following, the same reference numerals are used to describe the same elements as those in the second embodiment, and the elements (parts) differs from those in the second embodiment are mainly described. Further, in this embodiment, the outline of the recording medium heating apparatus (heating unit) 350-A, the configurations of the preprocessing apparatus (preprocessing liquid application and drying apparatus) 220-A and the printing system 200-A are the same as those in the second embodiment. Therefore, the descriptions thereof are basically omitted except for referring to FIGS. 4, 6, and 7.

Similar to the third embodiment, the recording medium heating apparatus (heating unit) 350-A includes a front-surface heating unit 351 on the upper side thereof and a rear-surface heating unit 352 on the lower side thereof. The front-surface heating unit 351 includes the first front-surface heat roller 40*b*, the second front-surface heat roller 50*b*, and the third front-surface heat roller 60*b*. The rear-surface heating unit 352 includes the first rear-surface heat roller 40*a*, the second rear-surface heat roller 50*a*, the third rear-surface heat roller 60*a*, and the discharge feed roller 70.

Further, there is formed the outlet 79 of the recording medium heating apparatus (heating unit) 350-A, and there is an outlet sensor 71 disposed near the outlet 79. Further, a control apparatus 80-B and the outlet sensor 71 may be disposed in either the front-surface heating unit 351 or the rear-surface heating unit 352.

FIG. 15 is a control block diagram of the printing system 200-A according to the fourth embodiment. As illustrated in FIG. 15, the control apparatus 80-B of the recording medium heating apparatus (heating unit) 350-A is included in a control system 450 of the printing system 200-A. The control apparatus 80-B of the recording medium heating apparatus (heating unit) 350-A includes the front-surface heating control section 81, the rear-surface heating control section 82, the CPU 83, and the memory 84.

Although not being illustrated, the control apparatus 80-B further includes a RAM and a ROM storing a program to be executed for heating, an I/O (input section) which controls the input and output of an electric component such as a sensor, and an I/F (interface section) for receiving data from a print control section 90.

As the control sections of the preprocessing apparatus (preprocessing liquid application and drying apparatus) 220-A, there are the control apparatus 80-B of the recording medium heating apparatus (heating unit) 350-A, an application control section 221 of the rear-surface application unit 33 and the front-surface application unit 34, a feeding control section 222 for controlling the feeding and the like. Further, the control system 450 includes the print control section 90 that controls the entire printing system 200-A including the preprocessing apparatus (preprocessing liquid application and drying apparatus) 220-A and the like.

In the preprocessing apparatus (preprocessing liquid application and drying apparatus) 220-A, the application control section 221 is connected to the rear-surface application unit 33 and the front-surface application unit 34 to control the rear-surface application unit 33 and the front-surface application unit 34. The feeding control section 222 is connected to the outfeed roller 335, the feed roller 359, the dancer unit 380, the air loop unit 320 and the like to control feeding of the recording medium 10.

Further, the control system 450 is connected to the printing system 200-A including the preprocessing apparatus (preprocessing liquid application and drying apparatus) 220-A and includes the print control section 90 that controls the entire printing system 200-A and the like. The print control section 90 is connected to the operation panel 91, the personal computer (including a server or the like) 92, the sheet supplying apparatus 210, the first inkjet printer 230, the second inkjet printer 250, the post drying apparatus 260, and the winding apparatus 270 via plural data lines and the like. The print control section 90 performs general control on the image forming processes including a process of drying preprocessing liquid.

The control apparatus 80-B of the recording medium heating apparatus (heating unit) 350-A includes the front-surface heating control section 81, the rear-surface heating control section 82, the CPU 83, and the memory 84 and the like. Based on the information acquired from the connected application control section 221, the feeding control section 222, the print control section 90 and the like, the CPU 83 controls the front-surface heating control section 81 and the rear-surface heating control section 82.

The control apparatus 80-B controls the temperatures of the heat rollers 40*a*-60*b* based on actuated conditions including, for example, the temperatures of the heat rollers 40*a*-60*b* detected by the temperature sensors 42*a*-62*b* and the rotational speed of the feed roller 359 for discharging and/or the outfeed roller 335 for supplying.

The rear-surface heating control section 82 collectively controls the first rear-surface heat roller 40*a*, the second rear-surface heat roller 50*a*, and the third rear-surface heat roller 60*a* in the respective roller sets as the recording medium rear-surface heat roller group. Further, the front-surface heating control section 81 collectively controls the first front-surface heat roller 40*b*, the second front-surface heat roller 50*b*, and the third front-surface heat roller 60*b* in the respective roller sets as the recording medium front-surface heat roller group.

In this embodiment, to dry the applied preprocessing liquid, the front-surface heating control section 81 and the rear-surface heating control section 82 perform the heat control similar to the control that is performed on the rear-surface application unit 33 and the front-surface application unit 34, and the front-surface image forming unit 111 and the rear-surface image forming unit 112 in the third embodiment.

A detailed control method in the embodiment is similar to that in the third embodiment described with reference to FIG. 12. Therefore, the repeated description thereof is omitted.

Further, in the third embodiment, it is ink that is evaporated. In the fourth embodiment, it is the solvent of the preprocessing liquid that is to be evaporated. However, the temperature setting method in this embodiment is substantially the same as that described above. Namely, the control is performed based on the flow described below based on Formula (1) above and the controlled values as shown in FIG. 12.

Next, the operations of the printing system 200-A are described with reference to the flowchart in FIG. 16. FIG. 16 is a flowchart illustrating the control performed in the printing system 200-A. As illustrated in FIG. 16, when an instruction to start printing is issued from the operation panel 91 or the personal computer (including a server or the like) 92 (step S200), the printing system 200-A system starts the preparations for printing by the print control section 90 (step S210).

In this case, the print control section 90 recognizes (receives) the information items from the operation panel 91 or the personal computer (including a server or the like) 92, the information items indicating the printing state, the recording medium, and the feeding of the recording medium, which are used for determining the setting temperatures of the heat rollers 40*a*-60*b* (step S220). The information indicating the printing state refers to the information indicating whether the printing is single-sided printing, rear-side printing, or double-sided printing.

The information indicating the recording medium refers to the information indicating, for example, the type (e.g., ordinary sheet, coated sheet or the like), the width, the weight of the recording medium. The information indicating feeding of the recording medium refers to the information indicating, for example, the feeding speed, the feeding amounts (corresponding number of pages).

Next, the print control section 90 further recognizes the information of the first inkjet printer 230 and the second inkjet printer 250 from the operation panel 91 or the personal computer (including a server or the like) 92, the information indicating whether data (image) are recorded on the recording medium 10. When data are recorded, the print control section 90 further recognizes, for example, the recording surface(s) (i.e., single-sided or double-sided, and the front surface or the rear surface in case of single-sided).

The information items recognized by the print control section 90 are classified by the control apparatus 80-B of the recording medium heating apparatus (heating unit) 350-A into two cases: one is a case of double-sided printing where it is necessary to heat both sides (i.e., the front surface and the rear surface) of the recording medium 10, and the other is a case of single-sided printing where it is necessary to heat one side of the recording medium 10 (step S230).

In the case where it is necessary to heat both surfaces of the recording medium 10, for example, the control apparatus 80-B causes the heaters 41*a*-61*b* of the heat rollers 40*a*-60*b* to operate to have the heat roller setting temperatures determined based on the printing state as shown in Table 1. By doing this, the temperatures of the recording medium heating apparatus (heating unit) 350-A, which is the drying section of the preprocessing apparatus (preprocessing liquid application and drying apparatus) 220-A for drying the preprocessing liquid of the are increased (step S240).

Based on the output of the temperature sensors 42*a*-62*b*, the control apparatus 80-B of the recording medium heating apparatus (heating unit) 350-A determines whether the heat rollers 40*a*-60*b* are heated up to the respective setting temperatures (step S250).

Further, when it is necessary to heat only one surface of the recording medium 10 in step S230, the CPU 83 of the control apparatus 80-B determines which of the recording medium rear-surface heat roller group 40*a*, 50*a*, and 60*a* and the recording medium front-surface heat roller group 40*b*, 50*b*, and 60*b* are to be heated (step S260).

Further, in the heat rollers 40*a*-60*b* in the recording medium rear-surface heat roller group and the recording medium front-surface heat roller group, for example, the control apparatus 80-B causes the heaters 41*a*-61*b* of the heat rollers 40*a*-60*b* to operate to heat in accordance with the relationship as shown in Table 1 previously determined based on the printing state. By doing this, the temperatures of the control apparatus 80-B of the recording medium heating apparatus (heating unit) 350-A, which is the drying section of the preprocessing apparatus (preprocessing liquid application and drying apparatus) 220-A, is increased (steps S270*a* and S270*b*).

Next, based on the output of the temperature sensors 42*a*-62*b*, the control apparatus 80-B determines whether the temperatures of the heat rollers 40*a*-60*b* reach the respective setting temperatures (step S280).

Then, when the temperatures of the heat rollers 40*a*-60*b* reach the respective setting temperatures (YES in step S250 or S280), the feeding control section 222 and the like drive the sheet supplying apparatus 210, the feed-in (FI) roller 322, the infeed roller 331, the outfeed roller 335, and the pressing roller 339 to feed the recording medium 10. At the same time, the feeding control section 222 operates the preprocessing liquid application apparatus (preprocessing liquid application unit) 330 to apply the preprocessing liquid onto the recording medium 10 (step S290).

The control apparatus 80-B determines whether the part (the edge end of the part) where the preprocessing liquid is applied onto the recording medium 10 reaches an inkjet head section (image forming section) 231 of the first inkjet printer 230 (step S300).

The determination whether the edge end of the part where the preprocessing liquid is applied onto the recording medium 10 reaches the inkjet head section (image forming section) 231 is made based on the discharge timings of the preprocessing liquid, the feeding amount of the outfeed roller 335, the feed roller 359, and the guide roller 382, the position of the movable frame 384 and the like. For example, the determination may be made by calculating a required time period based on the feeding distance and the feeding speed of the recording medium 10 and comparing the required time period and a result of counting the time.

When the edge end of the part where the preprocessing liquid is applied onto the recording medium 10 reaches the inkjet head section (image forming section) 231 of the first inkjet printer 230, the print control section 90 of the control system 450 operates the first inkjet printer 230 to start printing (step S310).

Similarly, when the edge end of the part where the preprocessing liquid is applied onto the recording medium 10 reaches the inkjet head section (image forming section) 251 of the second inkjet printer 250, the print control section 90 of the control system 450 operates the second inkjet printer 250.

Next, the print control section 90 of the control system 450 determines whether printing is finished (step S320).

When printing is finished, the application control section 221 of the control system 450 stops the application of the preprocessing liquid by the preprocessing liquid application apparatus (preprocessing liquid application unit) 330 (step S330).

Then, the control apparatus 80-B of the control system 450 determines whether the edge end of the part where the preprocessing liquid is applied on the recording medium 10 is discharged from the recording medium heating apparatus (heating unit) 350-A (step S340). The determination whether the edge end of the part where the preprocessing liquid is applied on the recording medium 10 is discharged from the recording medium heating apparatus (heating unit) 350-A is made based on the discharge timings of the preprocessing liquid, the feeding amount of the outfeed roller 335, the feed roller 359, and the guide roller 382, the position of the movable frame 384 and the like.

For example, the determination may be made by calculating a required time period based on the feeding distance and the feeding speed of the recording medium 10 and comparing the required time period and a result of counting the time.

When the edge end of the part where the preprocessing liquid is applied onto the recording medium 10 is discharged from the recording medium heating apparatus (heating unit) 350-A, the front-surface heating control section 81 and the rear-surface heating control section 82 turn off the operating heaters 41*a*-61*b* of the heat rollers 40*a*-60*b*, and the control apparatus 80-B stops the operation of the recording medium heating apparatus (heating unit) 350-A (step S350).

After that, the print control section 90 of the control system 450 stops feeding the recording medium 10 via the feeding control section 222 of the preprocessing apparatus (preprocessing liquid application and drying apparatus) 220-A, and the feeding control section 94 for another feeding section 355 and the discharge feed roller 70 (step S360).

Then, the control system 450 determines whether there is the next job (step S370). When there is the next job, the process goes back to step S210 to start preparing for printing. When there is no next job, the process ends (step S380).

According to the control described above, the recording medium 10 is in contact with the first heat roller set 40 whose temperature is the first setting temperature T1 that is the lowest among the first heat roller set 40, the second heat roller set 50, and the third heat roller set 60.

By doing this, it becomes possible to reduce the temperature difference between the recording medium 10 and the heat roller(s) with which the recording medium 10 is in first contact. Accordingly, when compared with a case where the temperature of all the heat rollers is set to the third setting temperature T3 which is the highest temperature, it becomes possible to prevent a sudden temperature increase of the recording medium 10.

Namely, it becomes possible for the system 200-A including the preprocessing apparatus (preprocessing liquid application and drying apparatus) 220-A having the recording medium heating apparatus (heating unit) 350-A to minimize a thermal load applied to the recording medium 10. Also, it becomes possible for the system 200-A to reduce the occurrence of damage (i.e., wrinkles, deformation and the like) to the recording medium 10 due to the lower thermal load.

In this fourth embodiment, the third heat roller set 60 supplies sufficient heat to the recording medium 10 to evaporate the solvent in the preprocessing liquid so that the solvent in the preprocessing liquid is less than or equal to a corresponding predetermined value. Therefore, it becomes possible for the system 200-A to improve the printing quality of image information formed on the recording medium 10.

Further, the control apparatus 80-B controls each of the heaters 41*a*-61*b* based on the type of the recording medium 10 (e.g., type of the sheet) and the printing mode (e.g., whether the printing is performed on one of the front surface and the rear surface or both if the position of the image forming area differs). By doing this, it becomes possible for the system 200-A to reduce the thermal load to the recording medium 10 when compared with the case where the same control is performed regardless of single-sided printing or double-sided printing.

Further, it becomes possible to effectively prevent the occurrence of damage (e.g., wrinkles or deformation) due to thermal load to the recording medium 10, the damage likely to occur especially when the recording medium 10 is a continuous form having an arbitrary length.

In the above first, second, third, and fourth embodiments, a case is described where the systems 100, 200, 100-A, and 200-A include three heat roller sets 40, 50, and 60. However, the number of the heat roller sets may be two or four or more.

Further, in the above first and second embodiments, a case is described where each of the heat roller sets includes two heat rollers. However, the number of heat rollers in the heat roller set may be three or more. Further, the number of the heat rollers may be separately determined among the heat roller sets.

As described above, according to an embodiment, it may become possible to heat the recording medium without causing damage to the recording medium 10.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A recording medium heating apparatus, comprising:

a plurality of heat roller sets disposed in a feeding path of a recording medium, wherein each of the heat roller sets includes a first heat roller having a heating unit and a second heat roller having a heating unit; and a control circuit configured to control temperatures of the heating units so that an average temperature of a first heat roller set is lower than an average temperature of a second heat roller set, and the first heat roller and the second heat roller of each of the first and second heat roller sets are controlled to have different temperatures.

2. A system, comprising:

the recording medium heating apparatus according to claim 1; and a recording apparatus disposed on an upstream side of the recording medium heating apparatus in the feeding path of the recording medium and configured to adhere ink to the recording medium.

3. A system, comprising:

the recording medium heating apparatus according to claim 1; and a preprocessing apparatus disposed on an upstream side of the recording medium heating apparatus in the feeding path of the recording medium and configured to apply preprocessing liquid to the recording medium.

4. A recording medium heating apparatus, comprising:

a plurality of heat roller sets disposed in a feeding path of a recording medium, wherein each of the heat roller sets includes a heat roller having a heating unit and being in contact with one surface of the recording medium and another heat roller having a heating unit and being in contact with another surface of the recording medium; and a control circuit configured to control temperatures of both of the heating units in each heat roller set so that the temperature of each of the heat rollers of a first heat roller set is lower than the temperature of each of the heat rollers in a second heat roller set, and the temperature of each of the heat rollers of the second heat roller set is lower than the temperature of each of the heat rollers in a third heat roller set, wherein the first, the second, and the third heat roller sets are included in the plurality of heat roller sets and the first heat roller set is disposed on the upstream side of the second heat roller set and the second heat roller set is disposed on the upstream side of the third heat roller set in the feeding path.

5. The recording medium heating apparatus according to claim 4, wherein the heat rollers are arranged in a zigzag manner.

6. The recording medium heating apparatus according to claim 5, wherein the heat rollers arranged in the zigzag manner are included in either a one-surface heat roller group or an another-surface heat roller group, the one-surface heat roller group including the heat rollers that are to be in contact with the one surface of the recording medium, the another-surface heat roller group including the heat rollers that are to be in contact with the another surface of the recording medium, and wherein the control unit is configured to control temperatures of the heating units so that the temperature of the heating units of the one-surface heat roller group is different from the temperatures of the heating units of the another-surface heat roller group.

7. A system, comprising:

the recording medium heating apparatus according to claim 6; and a recording apparatus disposed on an upstream side of the recording medium heating apparatus in the feeding path of the recording medium and configured to adhere ink to the recording medium.

8. A system, comprising:

the recording medium heating apparatus according to claim 6; and a preprocessing apparatus disposed on an upstream side of the recording medium heating apparatus in the feeding path of the recording medium and configured to apply preprocessing liquid to the recording medium.

9. A system, comprising:

the recording medium heating apparatus according to claim 5; and a recording apparatus disposed on an upstream side of the recording medium heating apparatus in the feeding path of the recording medium and configured to adhere ink to the recording medium.

10. A system, comprising:

the recording medium heating apparatus according to claim 5; and a preprocessing apparatus disposed on an upstream side of the recording medium heating apparatus in the feeding path of the recording medium and configured to apply preprocessing liquid to the recording medium.

11. A system, comprising:

the recording medium heating apparatus according to claim 4; and a recording apparatus disposed on an upstream side of the recording medium heating apparatus in the feeding path of the recording medium and configured to adhere ink to the recording medium.

12. A system, comprising:

the recording medium heating apparatus according to claim 4; and a preprocessing apparatus disposed on an upstream side of the recording medium heating apparatus in the feeding path of the recording medium and configured to apply preprocessing liquid to the recording medium.

13. A recording medium heating apparatus, comprising:

a plurality of heat roller sets disposed in a feeding path of a recording medium, wherein each of the heat roller sets includes a first heat roller having a heating unit and being in contact with one surface of the recording medium and second heat roller having a heating unit and being in contact with another surface of the recording medium; and a control circuit configured to control temperatures of both of the heating units in each heat roller set so that either all of the first heat rollers or all of the second heat rollers of each heat roller set are set to temperatures that increase in the order of a first heat roller set, a second heat roller set, and a third heat roller set, wherein the first, second, and third heat roller sets are included in the plurality of heat roller sets.

* * * * *